US012065784B2

(12) United States Patent
Martin et al.

(10) Patent No.: US 12,065,784 B2
(45) Date of Patent: Aug. 20, 2024

(54) COMPOSITE LAMINATED PAPERMAKING FABRICS AND METHODS OF MAKING THE SAME

(71) Applicant: First Quality Tissue Se, LLC, Anderson, SC (US)

(72) Inventors: Chad Martin, Appleton, WI (US); Robbie Edmonds, Island, KY (US); Allan Manninen, Stittsville (CA); Chi Zhang, Kanata (CA); Hongjian Zhou, Kanata (CA); James E. Sealey, II, Belton, SC (US); Byrd Tyler Miller, IV, Easley, SC (US); Marc Paul Begin, Simpsonville, SC (US); Justin S. Pence, Williamston, SC (US)

(73) Assignee: First Quality Tissue Se, LLC, Anderson, SC (US)

( * ) Notice: Subject to any disclaimer, the term of this patent is extended or adjusted under 35 U.S.C. 154(b) by 21 days.

(21) Appl. No.: 17/885,871

(22) Filed: Aug. 11, 2022

(65) Prior Publication Data

US 2023/0054966 A1 Feb. 23, 2023

Related U.S. Application Data

(60) Provisional application No. 63/231,772, filed on Aug. 11, 2021.

(51) Int. Cl.
*D21F 7/08* (2006.01)
*D21F 7/10* (2006.01)

(52) U.S. Cl.
CPC ..... *D21F 7/083* (2013.01); *D21F 7/10* (2013.01)

(58) Field of Classification Search
CPC ..... D21F 7/083; D21F 7/10; D21F 1/0063; D21F 11/006; D21F 1/0036; B32B 5/275
See application file for complete search history.

(56) References Cited

U.S. PATENT DOCUMENTS 3,143,150 A 8/1964 Buchanan
3,473,576 A 10/1969 Amneus
(Continued)

FOREIGN PATENT DOCUMENTS

EP 1339915 B1 7/2007
JP 2001226842 A 8/2001
(Continued)

OTHER PUBLICATIONS

W. Richard Leaitch et al. Vertical profiles of light absorption and scattering associated with black carbon particle fractions . . . . Published by Copernicus Publications on behalf of the European Geosciences Union. Atmos. Chem. Phys., 20, 10545-10563, 2020 (Year: 2020).*

(Continued)

*Primary Examiner* — Jacob T Minskey
*Assistant Examiner* — Matthew M Eslami
(74) *Attorney, Agent, or Firm* — Amster, Rothstein & Ebenstein LLP

(57) ABSTRACT

A structured tissue belt assembly including a supporting layer and a nonwoven web contacting layer. The supporting layer has a top surface and a bottom surface and is formed of monofilaments including one or more layers of warp yarns interwoven with weft yarns in a repeating pattern. At least one of: a) at least some of the warp yarns; or b) at least some of the weft yarns, include laser energy absorbent material, and at least one of: a) at least some of the warp yarns; or b) at least some of the weft yarns include laser energy scattering material. Laser welds attach the bottom surface of the web contacting layer to the top surface of the supporting layer at points where the web contacting layer contacts the at least one of: a) the at least some of the warp yarns; or b) the at least some of the weft yarns that include laser energy absorbent material.

38 Claims, 7 Drawing Sheets

(56) References Cited

U.S. PATENT DOCUMENTS

| | | | |
|---|---|---|---|
| 3,573,164 | A | 3/1971 | Friedberg et al. |
| 3,905,863 | A | 9/1975 | Ayers |
| 3,974,025 | A | 8/1976 | Ayers |
| 3,994,771 | A | 11/1976 | Morgan, Jr. et al. |
| 4,102,737 | A | 7/1978 | Morton |
| 4,184,519 | A | 1/1980 | McDonald et al. |
| 4,191,609 | A | 3/1980 | Trokhan |
| 4,514,345 | A | 4/1985 | Johnson et al. |
| 4,528,239 | A | 7/1985 | Trokhan |
| 4,529,480 | A | 7/1985 | Trokhan |
| 4,637,859 | A | 1/1987 | Trokhan |
| 4,909,284 | A | 3/1990 | Kositzke |
| 5,334,289 | A | 8/1994 | Trokhan et al. |
| 5,510,002 | A | 4/1996 | Hermans et al. |
| 5,607,551 | A | 3/1997 | Farrington, Jr. et al. |
| 5,679,222 | A | 10/1997 | Rasch et al. |
| 5,806,569 | A | 9/1998 | Gulya et al. |
| 6,120,642 | A | 9/2000 | Lindsay et al. |
| 6,610,173 | B1 | 8/2003 | Lindsay et al. |
| 6,660,362 | B1 | 12/2003 | Lindsay et al. |
| 6,821,391 | B2 | 11/2004 | Scherb et al. |
| 6,878,238 | B2 | 4/2005 | Bakken et al. |
| 6,998,017 | B2 | 2/2006 | Lindsay et al. |
| 7,339,378 | B2 | 3/2008 | Oc et al. |
| 7,387,706 | B2 | 6/2008 | Herman et al. |
| 7,442,278 | B2 | 10/2008 | Murray et al. |
| 7,494,563 | B2 | 2/2009 | Edwards et al. |
| 7,510,631 | B2 | 3/2009 | Scherb et al. |
| 7,582,187 | B2 | 9/2009 | Scherb et al. |
| 7,686,923 | B2 | 3/2010 | Scherb et al. |
| 7,744,726 | B2 | 6/2010 | Scherb et al. |
| 7,811,418 | B2 | 10/2010 | Klerelid et al. |
| 7,905,989 | B2 | 3/2011 | Scherb et al. |
| 7,931,781 | B2 | 4/2011 | Scherb et al. |
| 8,062,480 | B2 | 11/2011 | Eagles |
| 8,075,739 | B2 | 12/2011 | Scherb et al. |
| 8,092,652 | B2 | 1/2012 | Scherb et al. |
| 8,382,956 | B2 | 2/2013 | Boechat et al. |
| 8,580,083 | B2 | 11/2013 | Boechat et al. |
| 8,968,508 | B2 | 3/2015 | Schindler et al. |
| 8,980,062 | B2 | 3/2015 | Karlsson et al. |
| 10,099,425 | B2 | 10/2018 | Miller, IV et al. |
| 10,208,426 | B2 | 2/2019 | Sealey et al. |
| 2008/0156450 | A1 | 7/2008 | Klerelid et al. |
| 2009/0139600 | A1 | 6/2009 | Best et al. |
| 2010/0065234 | A1 | 3/2010 | Klerelid et al. |
| 2011/0180223 | A1 | 7/2011 | Klerelid et al. |
| 2012/0135184 | A1 | 5/2012 | Lang |
| 2020/0061959 | A1 | 2/2020 | Roe et al. |
| 2021/0071364 | A1 | 3/2021 | Martin et al. |
| 2021/0078284 | A1* | 3/2021 | Martin ..... D21F 7/12 |

FOREIGN PATENT DOCUMENTS

| | | | |
|---|---|---|---|
| JP | 3932238 | B2 | 6/2007 |
| JP | 2013256720 | A * | 12/2013 |
| JP | 2013256720 | A | 12/2013 |
| JP | 2015197614 | A | 11/2015 |
| WO | 2009067079 | A1 | 5/2009 |
| WO | 2019028052 | A1 | 2/2019 |

OTHER PUBLICATIONS

International Search Report and Written Opinion issued in PCT/US2022/040051, mailed Feb. 1, 2023.
U.S. Appl. No. 62/897,596, filed Sep. 9, 2019.
U.S. Appl. No. 15/148,851, filed May 6, 2016.
U.S. Appl. No. 15/170,746, filed Jun. 1, 2016.
U.S. Appl. No. 15/170,760, filed Jun. 1, 2016.
U.S. Appl. No. 15/182,391, filed Jun. 14, 2016.
U.S. Appl. No. 15/443,885, filed Feb. 27, 2017.
U.S. Appl. No. 15/642,133, filed Jul. 5, 2017.
U.S. Appl. No. 15/614,156, filed Jun. 5, 2017 . . . .
U.S. Appl. No. 16/115,723, filed Aug. 29, 2018.
U.S. Appl. No. 13/837,685, filed Mar. 15, 2013.
PCT International Patent Application No. PCT/US2013/53593, filed Aug. 5, 2013.
U.S. Appl. No. 14/534,631, filed Nov. 6, 2014.
European Patent Application No. 138226461.9, filed Aug. 5, 2013.
European Patent Application No. 18183329.4, filed Aug. 5, 2013.
U.S. Appl. No. 14/951,121, filed Nov. 24, 2015.
U.S. Appl. No. 16/353,160, filed Mar. 14, 2019.
U.S. Appl. No. 62/353,160, filed Nov. 24, 2014.
PCT International Patent Application No. PCT/US2015/62483, filed Nov. 24, 2015.
European Patent Application No. 15862667.1, filed Nov. 24, 2014.
U.S. Appl. No. 14/861,249, filed Sep. 22, 2015.
U.S. Appl. No. 15/959,925, filed Apr. 23, 2018.
U.S. Appl. No. 16/862,784, filed Apr. 30, 2020.
PCT International Patent Application No. PCT/US2015/64284, filed Dec. 7, 2015.
European Patent Application No. 15865639.7, filed Dec. 7, 2015.
U.S. Appl. No. 15/431,497, filed Feb. 13, 2017.
U.S. Appl. No. 15/811,174, filed Nov. 13, 2017.
U.S. Appl. No. 16/529,905, filed Aug. 2, 2019.
U.S. Appl. No. 16/229,428, filed Dec. 21, 2018.
U.S. Appl. No. 16/229,450, filed Dec. 21, 2018.
PCT International Patent Application No. PCT/US2017/17705, filed Feb. 13, 2017.
European Patent Application No. 17750977.5, filed Feb. 13, 2017.
Chinese Application No. 201780022396.1, filed Feb. 13, 2017.
U.S. Appl. No. 15/684,731, filed Aug. 23, 2017.
U.S. Appl. No. 16/810,917, filed Mar. 6, 2020.
PCT International Patent Application No. PCT/US2018/47463, filed Aug. 22, 2015.
European Patent Application No. 18848663.3, filed Aug. 22, 2018.
U.S. Appl. No. 16/412,873, filed May 15, 2018.
PCT Search Report and Written Opinion dated Sep. 30, 2020 in connection with PCT/US2020/034184.

* cited by examiner

COMPOSITE LAMINATED PAPERMAKING FABRICS AND METHODS OF MAKING THE SAME

RELATED APPLICATIONS

This application claims priority to and the benefit of U.S. Provisional Application No. 63/231,772, filed Aug. 11, 2021 and entitled COMPOSITE LAMINATED PAPERMAKING FABRICS, the contents of which are incorporated herein by reference in their entirety.

FIELD OF THE INVENTION

This disclosure relates to machines or apparatus for the production of paper making fabrics, and in particular to tissue paper making fabrics that are multilayered or composite fabrics, and methods of manufacturing such fabrics.

BACKGROUND

Tissue (sanitary tissue, facial tissue, paper towel, and napkin) manufacturers that can deliver the highest quality product at the lowest cost have a competitive advantage in the marketplace. A key component in determining the cost and quality of a tissue product is the manufacturing process utilized to create the product. For tissue products, there are several manufacturing processes available including conventional dry crepe (CDC), conventional wet crepe (CWC), through air drying (TAD), uncreped through air drying (UCTAD) or "hybrid" technologies such as Valmet's NTT and QRT processes, Georgia Pacific's ETAD, and Voith's ATMOS process. Each has differences as to installed capital cost, raw material utilization, energy cost, production rates, and the ability to generate desired tissue attributes such as softness, strength, and absorbency.

Conventional manufacturing processes include a forming section designed to retain a fiber, chemical, and filler recipe while allowing water to drain from a web. Many types of forming sections, such as inclined suction breast roll, gap former twin wire C-wrap, gap former twin wire S-wrap, suction forming roll, and Crescent formers, include the use of forming fabrics.

Forming fabrics are woven structures that utilize monofilaments (such as yarns or threads) composed of synthetic polymers (usually polyethylene terephthalate, or nylon). A forming fabric has two surfaces, a sheet side and a machine or wear side. The wear side is in contact with the elements that support and move the fabric and are thus prone to wear. To increase wear resistance and improve drainage, the wear side of the fabric has larger diameter monofilaments compared to the sheet side. The sheet side has finer yarns to promote fiber and filler retention on the fabric surface.

Different weave patterns are utilized to control other properties such as: fabric stability, life potential, drainage, fiber support, and clean-ability. There are three basic types of forming fabrics: single layer, double layer, and triple layer. A single layer fabric is composed of one yarn system made up of cross direction (CD) yarns (also known as shute yarns or weft yarns) and machine direction (MD) yarns (also known as warp yarns). The main issue for single layer fabrics is a lack of dimensional stability. A double layer forming fabric has one layer of warp yarns and two layers of shute yarns or weft yarns. This multilayer fabric is generally more stable and resistant to stretching. Triple layer fabrics have two separate single layer fabrics bound together by separated yarns called binders. Usually the binder fibers are placed in the cross direction but can also be oriented in the machine direction. Triple layer fabrics have further increased dimensional stability, wear potential, drainage, and fiber support than single or double layer fabrics.

The manufacturing of forming fabrics includes the following operations: weaving, initial heat setting, seaming, final heat setting, and finishing. The fabric is made in a loom using two interlacing sets of monofilaments (or threads or yarns). The longitudinal or machine direction threads are called warp threads and the transverse or cross machine direction threads are called shute threads. After weaving, the forming fabric is heated to relieve internal stresses to enhance dimensional stability of the fabric. The next step in manufacturing is seaming. This step converts the flat woven fabric into an endless forming fabric by joining the two MD ends of the fabric. After seaming, a final heat setting is applied to stabilize and relieve the stresses in the seam area. The final step in the manufacturing process is finishing, whereby the fabric is cut to width and sealed.

There are several parameters and tools used to characterize the properties of the forming fabric: mesh (warp count) and knock (weft count), caliper, frames, plane difference, percent open area, air permeability, tensile strength and modulus, stiffness, shear resistance, void volume and distribution, running attitude, fiber support index, drainage index, and stacking. None of these parameters can be used individually to precisely predict the performance of a forming fabric on a paper machine, but together the expected performance and sheet properties can be estimated. Examples of forming fabric designs can be viewed in U.S. Pat. Nos. 3,143,150, 4,184,519, 4,909,284, and 5,806,569.

In a CDC or CWC process, after web formation and drainage (to around 35% solids) in the forming section (assisted by centripetal force around the forming roll and, in some cases, vacuum boxes), a web is transferred from the forming fabric to a press fabric upon which the web is pressed between a rubber or polyurethane covered suction pressure roll and a steam heated cylinder referred to as the Yankee dryer. The press fabric is a permeable fabric designed to uptake water from the web as it is pressed in the press section. It is composed of large monofilaments or multi-filamentous yarns, needled with fine synthetic batt fibers to form a smooth surface for even web pressing against the Yankee dryer. Removing water via pressing reduces energy consumption compared to using heat. The web is transferred to the Yankee Dryer then dried (with assistance of a hot air impingement hood) and creped from the Yankee Dryer and reeled. When creped at a solids content of less than 90%, the process is referred to as Conventional Wet Crepe. When creped at a solids content of greater than 90%, the process is referred to as Conventional Dry Crepe. These processes can be further understood by reviewing Yankee Dryer and Drying, A TAPPI PRESS Anthology, pg 215-219, the contents of which are incorporated herein by reference in their entirety.

In a conventional TAD process, rather than pressing and compacting the web, as is performed in conventional dry crepe, the web undergoes the steps of imprinting and thermal pre-drying. Imprinting is a step in the process where the web is transferred from a forming fabric to a structured fabric (structuring or imprinting fabric) and subsequently pulled into the structured fabric using vacuum (referred to as imprinting or molding). This step imprints the weave pattern (or knuckle pattern) of the structured fabric into the web. This imprinting step increases softness of the web, and affects smoothness and the bulk structure. The monofilaments of the fabric are typically round in shape but can also be square or rectangular. The web contacting side of the fabric is sometimes sanded to provide higher contact area when pressing against the Yankee dryer to facilitate web transfer. The manufacturing method of an imprinting fabric is similar to a forming fabric (see U.S. Pat. Nos. 3,473,576, 3,573,164, 3,905,863, 3,974,025, and 4,191,609 for examples) except in some cases an additional step of overlaying a polymer is conducted.

Imprinting fabrics with an overlaid polymer are disclosed in U.S. Pat. Nos. 6,120,642, 5,679,222, 4,514,345, 5,334,289, 4,528,239 and 4,637,859. Specifically, these patents disclose a method of forming a fabric in which a patterned resin is applied over a woven substrate. The patterned resin completely penetrates the woven substrate. The top surface of the patterned resin is flat and openings in the resin have sides that follow a linear path as the sides approach and then penetrate the woven structure.

U.S. Pat. Nos. 6,610,173, 6,660,362, 6,878,238 and 6,998,017, and European Patent No. EP 1 339 915 disclose another technique for applying an overlaid resin to a woven imprinting fabric. According to this technique, the overlaid polymer has an asymmetrical cross sectional profile in at least one of the machine direction and a cross direction and at least one nonlinear side relative to the vertical axis. The top portion of the overlaid resin can be a variety of shapes and not simply a flat structure. The sides of the overlaid resin, as the resin approaches and then penetrates the woven structure, can also take different forms, not a simple linear path 90 degrees relative to the vertical axis of the fabric. Both methods result in a patterned resin applied over a woven substrate. The benefit is that resulting patterns are not limited by a woven structure and can be created in any desired shape to enable a higher level of control of the web structure and topography that dictate web quality properties.

After imprinting, the web is thermally pre-dried by moving hot air through the web while it is conveyed on the structured fabric. Thermal pre-drying can be used to dry the web to over 90% solids before the web is transferred to a steam heated cylinder. The web is then transferred from the structured fabric to the steam heated cylinder through a very low intensity nip (up to 10 times less than a conventional press nip) between a solid pressure roll and the steam heated cylinder. The portions of the web that are pressed between the pressure roll and steam cylinder rest on knuckles of the structured fabric; thereby protecting most of the web from the light compaction that occurs in this nip. The steam cylinder and an optional air cap system, for impinging hot air, then dry the sheet to up to 99% solids during the drying stage before creping occurs. The creping step of the process again only affects the knuckle sections of the web that are in contact with the steam cylinder surface. Due to only the knuckles of the web being creped, along with the dominant surface topography being generated by the structured fabric, and the higher thickness of the TAD web, the creping process has a much smaller effect on overall softness as compared to conventional dry crepe. After creping, the web is optionally calendared and reeled into a parent roll and ready for a converting process. Some TAD machines utilize fabrics (similar to dryer fabrics) to support the sheet from the crepe blade to the reel drum to aid in sheet stability and productivity. Patents which describe creped through air dried products include U.S. Pat. Nos. 3,994,771, 4,102,737, 4,529,480, and 5,510,002.

The TAD process generally has higher capital costs as compared to a conventional tissue machine due to the amount of air handling equipment needed for the TAD section. Also, the TAD process has a higher energy consumption rate due to the need to burn natural gas or other fuels for thermal pre-drying. However, the bulk softness and absorbency of a paper product made from the TAD process is superior to conventional paper due to the superior bulk generation via structured fabrics, which creates a low density, high void volume web that retains its bulk when wetted. The surface smoothness of a TAD web can approach that of a conventional tissue web. The productivity of a TAD machine is less than that of a conventional tissue machine due to the complexity of the process and the difficulty of providing a robust and stable coating package on the Yankee dryer needed for transfer and creping of a delicate pre-dried web.

UCTAD (un-creped through air drying) is a variation of the TAD process in which the sheet is not creped, but rather dried up to 99% solids using thermal drying, blown off the structured fabric (using air), and then optionally calendared and reeled. U.S. Pat. No. 5,607,551 describes an uncreped through air dried product.

A process/method and paper machine system for producing tissue has been developed by the Voith company and is marketed under the name ATMOS. The process/method and paper machine system have several variations, but all involve the use of a structured fabric in conjunction with a belt press. The major steps of the ATMOS process and its variations are stock preparation, forming, imprinting, pressing (using a belt press), creping, calendaring (optional), and reeling the web.

The stock preparation step of the ATMOS process is the same as that of a conventional or TAD machine. The forming process can utilize a twin wire former (as described in U.S. Pat. No. 7,744,726), a Crescent Former with a suction Forming Roll (as described in U.S. Pat. No. 6,821,391), or a Crescent Former (as described in U.S. Pat. No. 7,387,706). The former is provided with a slurry from the headbox to a nip formed by a structured fabric (inner position/in contact with the forming roll) and forming fabric (outer position). The fibers from the slurry are predominately collected in the valleys (or pockets, pillows) of the structured fabric and the web is dewatered through the forming fabric. This method for forming the web results in a bulk structure and surface topography as described in U.S. Pat. No. 7,387,706 (FIGS. 1-11). After the forming roll, the structured and forming fabrics separate, with the web remaining in contact with the structured fabric.

The web is then transported on the structured fabric to a belt press. The belt press can have multiple configurations. The press dewaters the web while protecting the areas of the sheet within the structured fabric valleys from compaction. Moisture is pressed out of the web, through the dewatering fabric, and into the vacuum roll. The press belt is permeable and allows for air to pass through the belt, web, and dewatering fabric, and into the vacuum roll, thereby enhancing the moisture removal. Since both the belt and dewatering fabric are permeable, a hot air hood can be placed inside of the belt press to further enhance moisture removal. Alternately, the belt press can have a pressing device which includes several press shoes, with individual actuators to control cross direction moisture profile, or a press roll. A common arrangement of the belt press has the web pressed against a permeable dewatering fabric across a vacuum roll by a permeable extended nip belt press. Inside the belt press is a hot air hood that includes a steam shower to enhance moisture removal. The hot air hood apparatus over the belt press can be made more energy efficient by reusing a portion of heated exhaust air from the Yankee air cap or recirculating a portion of the exhaust air from the hot air apparatus itself.

After the belt press, a second press is used to nip the web between the structured fabric and dewatering felt by one hard and one soft roll. The press roll under the dewatering fabric can be supplied with vacuum to further assist water removal. This belt press arrangement is described in U.S. Pat. Nos. 8,382,956 and 8,580,083, with FIG. 1 showing the arrangement. Rather than sending the web through a second press after the belt press, the web can travel through a boost dryer, a high pressure through air dryer, a two pass high pressure through air dryer or a vacuum box with hot air supply hood. U.S. Pat. Nos. 7,510,631, 7,686,923, 7,931,781, 8,075,739, and 8,092,652 further describe methods and systems for using a belt press and structured fabric to make tissue products each having variations in fabric designs, nip pressures, dwell times, etc. A wire turning roll can also be utilized with vacuum before the sheet is transferred to a steam heated cylinder via a pressure roll nip.

The sheet is then transferred to a steam heated cylinder via a press element. The press element can be a through drilled (bored) pressure roll, a through drilled (bored) and blind drilled (blind bored) pressure roll, or a shoe press. After the web leaves this press element and before it contacts the steam heated cylinder, the % solids are in the range of 40-50%. The steam heated cylinder is coated with chemistry to aid in sticking the sheet to the cylinder at the press element nip and also to aid in removal of the sheet at the doctor blade. The sheet is dried to up to 99% solids by the steam heated cylinder and an installed hot air impingement hood over the cylinder. This drying process, the coating of the cylinder with chemistry, and the removal of the web with doctoring is explained in U.S. Pat. Nos. 7,582,187 and 7,905,989. The doctoring of the sheet off the Yankee, i.e., creping, is similar to that of TAD with only the knuckle sections of the web being creped. Thus, the dominant surface topography is generated by the structured fabric, with the creping process having a much smaller effect on overall softness as compared to conventional dry crepe. The web is now calendared (optional), slit, reeled and ready for the converting process.

The ATMOS process has capital costs between that of a conventional tissue machine and a TAD machine. It uses more fabrics and a more complex drying system compared to a conventional machine, but uses less equipment than a TAD machine. The energy costs are also between that of a conventional and a TAD machine due to the energy efficient hot air hood and belt press. The productivity of the ATMOS machine has been limited due to the inability of the novel belt press and hood to fully dewater the web and poor web transfer to the Yankee dryer, likely driven by poor supported coating packages, the inability of the process to utilize structured fabric release chemistry, and the inability to utilize overlaid fabrics to increase web contact area to the dryer. Poor adhesion of the web to the Yankee dryer has resulted in poor creping and stretch development which contributes to sheet handling issues in the reel section. The result is that the output of an ATMOS machine is currently below that of conventional and TAD machines. The bulk softness and absorbency is superior to conventional, but lower than a TAD web since some compaction of the sheet occurs within the belt press, especially areas of the web not protected within the pockets of the fabric. Also, bulk is limited since there is no speed differential to help drive the web into the structured fabric as exists on a TAD machine. The surface smoothness of an ATMOS web is between that of a TAD web and a conventional web primarily due to the current limitation on use of overlaid structured fabrics.

The ATMOS manufacturing technique is often described as a hybrid technology because it utilizes a structured fabric like the TAD process, but also utilizes energy efficient means to dewater the sheet like the conventional dry crepe process. Other manufacturing techniques which employ the use of a structured fabric along with an energy efficient dewatering process are the ETAD process and NTT process. The ETAD process and products are described in U.S. Pat. Nos. 7,339,378, 7,442,278, and 7,494,563. The NTT process and products are described in WO 2009/061079 A1, United States Patent Application Publication No. 2011/0180223 A1, and United States Patent Application Publication No. 2010/0065234 A1. The QRT process is described in United States Patent Application Publication No. 2008/0156450 A1 and U.S. Pat. No. 7,811,418. A structuring belt manufacturing process used for the NTT, QRT, and ETAD imprinting process is described in U.S. Pat. No. 8,980,062 and United States Patent Application Publication No. US 2010/0236034.

The NTT fabric forming process involves spirally winding strips of polymeric material, such as industrial strapping or ribbon material, and adjoining the sides of the strips of material using ultrasonic, infrared, or laser welding techniques to produce an endless belt. Optionally, a filler or gap material can be placed between the strips of material and melted using the aforementioned welding techniques to join the strips of materials. The strips of polymeric material are produced by an extrusion process from any polymeric resin such as polyester, polyamide, polyurethane, polypropylene, or polyether ether ketone resins. The strip material can also be reinforced by incorporating monofilaments of polymeric material into the strips during the extrusion process or by laminating a layer of woven polymer monofilaments or felt layer to the non-sheet contacting surface of a finished endless belt composed of welded strip material. The endless belt can have a textured surface produced using processes such as sanding, graving, embossing, or etching. The belt can be impermeable to air and water, or made permeable by processes such as punching, drilling, or laser drilling. Examples of structuring belts used in the NTT process can be viewed in International Publication Number WO 2009/067079 A1 and United States Patent Application Publication No. 2010/0065234 A1.

As shown in the aforementioned discussion of tissue papermaking technologies, the fabrics or belts utilized are critical in the development of the tissue web structure and topography which, in turn, are instrumental in determining the quality characteristics of the web such as softness (bulk softness and surfaces smoothness) and absorbency. The manufacturing process for making these fabrics has been limited to weaving a fabric (primarily forming fabrics and structured fabrics) or a base structure and needling synthetic fibers (press fabrics) or overlaying a polymeric resin (overlaid structured fabrics) to the fabric/base structure, or welding strips of polymeric material together to form an endless belt.

Conventional overlaid structures require application of an uncured polymer resin over a woven substrate where the resin completely penetrates through the thickness of the woven structure. Certain areas of the resin are cured and other areas are uncured and washed away from the woven structure. This results in a fabric where airflow through the fabric is only possible in the Z-direction. Thus, in order for the web to dry efficiently, only highly permeable fabrics can be utilized, meaning the amount of overlaid resin applied needs to be limited. If a fabric of low permeability is produced in this manner, then drying efficiency is significantly reduced, resulting in poor energy efficiency and/or low production rates as the web must be transported slowly across the TAD drums or ATMOS drum for sufficient drying. Similarly, a welded polymer structuring layer is extremely planar and provides an even surface when laminating to a woven support layer, which results in no air channels in the X-Y plane.

As described in U.S. Pat. No. 10,208,426 B2, fabrics comprised of extruded polymer netting laminated to a woven structure utilize less energy to dry the sheet compared to prior designs. Both the extruded polymer netting layer and woven layer have non-planar, irregularly shaped surfaces that when laminated together only weld together where the two layers come into direct contact. This creates air channels in the X-Y plane of the fabric through which air can travel when the sheet is being dried with hot air in the TAD, UCTAD, or ATMOS processes. Without being bound by theory, it is likely that the airflow path and dwell time is longer through this type of fabric, allowing the air to remove higher amounts of water compared to prior designs. Prior woven and overlaid designs create channels where airflow is channeled in the Z-direction by the physical restrictions imposed by the monofilaments or polymers of the belt that create the pocket boundaries of the belt. The polymer netting/woven structure design allows for less restricted airflow in the X-Y plane such that airflow can move parallel through the belt and web across multiple pocket boundaries and thereby increase contact time of the airflow within the web to remove additional water. This allows for the use of lower permeable belts compared to prior fabrics without increasing the energy demand per ton of paper dried. The air flow in the X-Y plane also reduces high velocity air flow in the Z-direction as the sheet and fabric pass across the molding box, reducing the occurrence of pin holes in the sheet.

Additionally, a process for manufacturing a structuring fabric or the web contacting layer of a laminated structuring fabric by laying down polymers of specific material properties in an additive manner under computer control (3-D printing) has been described in U.S. Pat. No. 10,099,425 and U.S. Provisional Patent Application No. 62/897,596.

All patents and patent applications mentioned herein are hereby incorporated by reference in their entirety.

SUMMARY OF THE INVENTION

An object of the present invention is to provide methods for making papermaking fabrics using laser energy and papermaking fabrics made in accordance with such methods.

A structured tissue belt assembly according to an exemplary embodiment of the present invention comprises: a supporting layer comprising a top surface and a bottom surface, the supporting layer being formed of monofilaments comprising one or more layers of warp yarns interwoven with weft yarns in a repeating pattern, at least one of: a) at least some of the warp yarns; or b) at least some of the weft yarns, comprising laser energy absorbent material, at least one of: a) at least some of the warp yarns; or b) at least some of the weft yarns, comprising laser energy scattering material; a non-woven web contacting layer comprising a bottom surface; and one or more first laser welds that attach the bottom surface of the web contacting layer to the top surface of the supporting layer at points where the web contacting layer contacts the at least one of: a) the at least some of the warp yarns; orb) the at least some of the weft yarns that comprise laser energy absorbent material, wherein the structured tissue belt assembly allows for air flow in x, y and z directions, wherein an embedment distance where the web contacting layer is embedded into the monofilaments of the supporting layer is from a distance of 0.05 mm to 0.60 mm or 0.1 mm to 0.5 mm or 0.15 mm to 0.45 mm or 0.05 mm to 0.70 mm, and wherein a peel force between the web contacting layer and the supporting layer is from 650 gf/inch to 6000 gf/inch or 700 gf/inch to 3000 gf/inch or 725 gf/inch to 1000 gf/inch 800 gf/inch to 1000 gf/inch or 500 gf/inch to 2000 gf/inch.

In an exemplary embodiment at least one of: a) at least some of the warp yarns; orb) at least some of the weft yarns, comprise polymers of varying crystallinities.

In an exemplary embodiment the non-woven web contacting layer comprises at least one of a laser energy scattering material or polymers of varying crystallinities.

In an exemplary embodiment at least some of the weft yarns are formed at least in part of the laser energy absorbent material.

In an exemplary embodiment at least some of the warp yarns are devoid of the laser energy absorbent material and contain a laser energy scattering material.

In an exemplary embodiment at least some of the warp yarns are formed of a laser energy scattering material and the at least some of the warp yarns are connected to the at least some of the weft yarns formed at least in part of the laser energy absorbent material at one or more second laser welds formed at points where the warp yarns pass over the weft yarns formed at least in part of the laser energy absorbent material.

In an exemplary embodiment the web contacting layer is attached to the top surface of the supporting layer by the one or more first laser welds formed between the bottom surface of the web contacting layer and the at least some of the weft yarns formed at least in part of the laser energy absorbent material at points where the at least some of the weft yarns form at least part of the top surface.

In an exemplary embodiment at least some of the warp yarns are formed at least in part of the laser energy absorbent material.

In an exemplary embodiment at least some of the weft yarns are devoid of laser energy absorbent material and contain a laser energy scattering material.

In an exemplary embodiment at least some of the weft yarns are formed of a laser energy scattering material and the at least some of the weft yarns are connected to the at least some of the warp yarns formed at least in part of the laser energy absorbent material at one or more second laser welds formed at points where the weft yarns pass over the warp yarns formed at least in part of the laser energy absorbent material.

In an exemplary embodiment the web contacting layer is attached to the top surface of the supporting layer by the one or more first laser welds formed between the bottom surface of the web contacting layer and the at least some of the warp yarns formed at least in part of the laser energy absorbent material at points where the at least some of the warp yarns form at least part of the top surface.

In an exemplary embodiment the warp yarns and the weft yarns are formed at least in part of a thermoplastic polymer, a thermoset polymer, or a combination thereof.

In an exemplary embodiment the polymer type is polyphenylene sulfide, poly 1,4-cyclohexanedicarbinyl terephthalate, polycyclohexanedimethylene terephthalate isophthalate, polybutylene terephthalate, polyester, polyamide, polyurethane, polypropylene, polyethylene, polyethylene terephthalate, polyether ether ketone resins or combinations thereof.

In an exemplary embodiment the warp yarns and the weft yarns are bicomponent yarns.

In an exemplary embodiment the warp yarns and the weft yarns have a consistent shape.

In an exemplary embodiment the warp yarns and the weft yarns have a varying shape.

In an exemplary embodiment the warp and the weft yarns have a shape selected from the group consisting of: circular, rectangular, star shaped, and oval shaped.

In an exemplary embodiment the web contacting layer is formed of an extruded polymer netting or a 3-D printed polymer.

In an exemplary embodiment the polymer is a thermoplastic polymer, a thermoset polymer, or a combination thereof.

In an exemplary embodiment the polymer is polyphenylene sulfide, poly 1,4-cyclohexanedicarbinyl terephthalate, polycyclohexanedimethylene terephthalate isophthalate, polybutylene terephthalate, polyester, polyamide, polyurethane, polypropylene, polyethylene, polyethylene terephthalate, polyether ether ketone resins or combinations thereof.

In an exemplary embodiment the laser energy absorbent material comprises carbon black.

In an exemplary embodiment the carbon black is present in at least one of the at least some of the warp yarns or the at least some of the weft yarns by an amount of from 0.05% to 5% by weight or 0.15% to 3% by weight or 0.40% to 2% by weight.

In an exemplary embodiment the at least some of the weft yarns that are formed at least in part of the laser energy absorbent material is from 25% to 100% of all weft yarns in the fabric assembly.

In an exemplary embodiment the at least some of the warp yarns that are formed at least in part of the laser energy absorbent material is from 25% to 100% of all warp yarns in the fabric assembly.

In an exemplary embodiment the laser energy scattering material comprises titanium dioxide.

In an exemplary embodiment the titanium dioxide is present in at least one of: a) at least some of the warp yarns; orb) at least some of the weft yarns, by an amount of from 0.05% to 5% by weight or 0.40% to 4% by weight or 0.50% to 2% by weight.

In an exemplary embodiment the at least some of the weft yarns that are formed at least in part of the laser energy scattering material is from 25% to 100% of all weft yarns in the fabric assembly.

In an exemplary embodiment the at least some of the warp yarns that are formed at least in part of the laser energy scattering material is from 25% to 100% of all warp yarns in the fabric assembly.

In an exemplary embodiment the non-woven web contacting layer comprises a laser energy scattering material in an amount from 0.0% to 5% by weight.

In an exemplary embodiment a peel force between the web contacting layer and the supporting layer is from 650 gf/inch to 6000 gf/in.

In an exemplary embodiment the peel force is from 2000 gf/in to 4500 gf/in.

In an exemplary embodiment a shear number of the structured tissue fabric belt assembly is from 35 PLI to 250 PLI.

In an exemplary embodiment the shear number is from 150 PLI to 225 PLI.

In an exemplary embodiment the embedment distance is from 0.10 mm to 0.36 mm.

In an exemplary embodiment the supporting layer comprises polymers of varying crystallinities, wherein the crystallinity of the polymers vary from 30% to 60%.

A method of making a structured tissue belt assembly according to an exemplary embodiment of the present invention comprises: providing a supporting layer made up of monofilaments comprising warp yarns and weft yarns interwoven in a repeating pattern, wherein at least one of: a) at least some of the warp yarns; or b) at least some of the weft yarns, are formed at least in part of a laser energy absorbent material, at least one of: a) at least some of the warp yarns; or b) at least some of the weft yarns, comprise a laser energy scattering material, and the supporting layer has a top surface; stretching a web contacting layer and impinging the web contacting layer onto the top surface of the supporting layer with a minimum of 1 PSI downward force; radiating the web contacting layer with a laser to form one or more first laser welds between a bottom surface of the web contacting layer and the top surface of the supporting layer at points where the web contacting layer contacts the at least one of: a) the at least some of the warp yarns or; b) the at least some of the weft yarns formed at least in part of the laser energy absorbent material, wherein an embedment distance where the web contacting layer is embedded into the monofilaments of the supporting layer is from 0.05 mm to 0.60 mm, and wherein a peel force between the web contacting layer and the supporting layer is from 650 gf/inch to 6000 gf/inch.

In an exemplary embodiment at least one of: a) at least some of the warp yarns; orb) at least some of the weft yarns, comprise polymers of varying crystallinities.

In an exemplary embodiment the non-woven web contacting layer comprises at least one of a laser energy scattering material or polymers of varying crystallinities.

In an exemplary embodiment the laser has a laser energy wavelength from 500 nm to 11000 nm.

In an exemplary embodiment at least some of the warp yarns are formed at least in part of a laser energy absorbent material.

In an exemplary embodiment at least some of the weft yarns are devoid of the laser energy absorbent material and contain a laser energy scattering material.

In an exemplary embodiment the at least some weft yarns are formed of a laser energy scattering material and the at least some of the weft yarns are connected to the at least some of the warp yarns formed at least in part of the laser energy absorbent material by one or more second laser welds formed at points where the weft yarns pass over the warp yarns formed at least in part of the laser energy absorbent material.

In an exemplary embodiment at least some of the weft yarns are formed at least in part of a laser energy absorbent material.

In an exemplary embodiment at least some of the warp yarns are devoid of the laser energy absorbent material and contain a laser energy scattering material.

In an exemplary embodiment the at least some of the warp yarns are formed of a laser energy scattering material and the at least some of the warp yarns are connected to the at least some of the weft yarns formed at least in part of the laser energy absorbent material by one or more second laser welds formed at points where the warp yarns pass over the weft yarns formed at least in part of the laser energy absorbent material.

In an exemplary embodiment the downward force is from 5 PSI to 15 PSI.

In an exemplary embodiment the laser has a power level of 100 to 1200 watts.

A structured tissue belt assembly according to an exemplary embodiment of the present invention comprises: a supporting layer comprising a top surface and a bottom surface, the supporting layer being formed of monofilaments comprising multiple layers of warp yarns interwoven with weft yarns in a repeating pattern, at least one of: a) at least some of the warp yarns; or b) at least some of the weft yarns, comprising laser energy absorbent material, and at least one of: a) at least some of the warp yarns; orb) at least some of the weft yarns, comprising laser energy scattering material; the supporting layer being needled with fine synthetic batting; and a web contacting layer; and one or more first laser welds that attach a bottom surface of the web contacting layer to the top surface of the supporting layer at points where the web contacting layer contacts the at least one of: a) the at least some of the warp yarns; or b) the at least some of the weft yarns that comprise laser energy absorbent material, wherein the structured tissue belt assembly allows for air flow in the x, y and z directions, wherein an embedment distance where the web contacting layer is embedded into the monofilaments of the supporting layer is from 0.05 mm to 0.60 mm, and wherein a peel force between the web contacting layer and the supporting layer is from 650 gf/inch to 6000 gf/inch.

In an exemplary embodiment at least one of: a) at least some of the warp yarns; orb) at least some of the weft yarns, comprise polymers of varying crystallinities.

In an exemplary embodiment the non-woven web contacting layer comprises at least one of a laser energy scattering material or polymers of varying crystallinities.

A structured tissue belt assembly according to an exemplary embodiment of the present invention comprises; a supporting layer comprising a top surface and a bottom surface, the supporting layer being formed of monofilaments comprising one or more layers of warp yarns interwoven with weft yarns in a repeating pattern, the warp yarns and the weft yarns being devoid of laser energy absorbent material, and at least one of: a) at least some of the warp yarns or b) at least some of the weft yarns, comprising laser energy scattering material; a non-woven web contacting layer at least a portion of which comprises a laser energy absorbent material; and one or more laser welds that attach the top surface of the supporting layer to a bottom surface of the web contacting layer at points where the at least a portion of the web contacting layer contacts at least one of: a) at least some of the warp yarns; orb) at least some of the weft yarns, wherein the structured tissue belt assembly allows for air flow in x, y and z directions, wherein an embedment distance where the web contacting layer is embedded into the monofilaments of the supporting layer is from 0.05 mm to 0.60 mm, and wherein a peel force between the web contacting layer and the supporting layer is from 650 gf/inch to 6000 gf/inch.

In an exemplary embodiment at least one of: a) at least some of the warp yarns; orb) at least some of the weft yarns, comprise polymers of varying crystallinities.

In an exemplary embodiment the non-woven web contacting layer comprises polymers of varying crystallinities.

A method of making a structured tissue belt assembly according to an exemplary embodiment of the present invention comprises: forming a non-woven web contacting layer comprising laser energy absorbent material; stretching the non-woven web contacting layer; providing a supporting layer comprising made up of monofilaments comprising warp yarns and weft yarns interwoven in a repeating pattern, wherein: the warp yarns and the weft yarns are devoid of laser energy transparent absorbent material, at least one of: a) at least some of the warp yarns; or b) at least some of the weft yarns, comprising a laser energy scattering material; impinging the top surface of the supporting layer to a bottom surface of the web contacting layer with a minimum of 1 PSI downward force; and radiating the supporting layer with a laser to form one or more laser welds that attach the bottom surface of the web contacting layer to the top surface of the supporting layer at points where the laser energy absorbent material of the web contacting layer contacts at least one of the warp yarns or the weft yarns of the supporting layer, wherein an embedment distance where the web contacting layer is embedded into the monofilaments of the supporting layer is from 0.05 mm to 0.60 mm, and wherein a peel force between the web contacting layer and the supporting layer is from 650 gf/inch to 6000 gf/inch.

In an exemplary embodiment at least one of: a) at least some of the warp yarns; orb) at least some of the weft yarns, comprise polymers of varying crystallinities.

A structured tissue belt assembly according to an exemplary embodiment of the present invention comprises: a supporting layer comprising a top surface and a bottom surface, the supporting layer being formed of monofilaments comprising multiple layers of warp yarns interwoven with weft yarns in a repeating pattern, the warp yarns and the weft yarns being devoid of laser energy absorbing material, at least one of: a) at least some of the warp yarns; orb) at least some of the weft yarns comprising a laser energy scattering material, and the supporting layer being needled with fine synthetic batting; a web contacting layer comprising a laser energy absorbent material; and one or more laser welds that attach a bottom surface of the web contacting layer to the top surface of the supporting layer at points where the laser energy absorbent material of the web contacting layer contacts at least one of the warp yarns or the weft yarns, wherein the structured tissue belt assembly allows for air flow in x, y and z directions, wherein an embedment distance where the web contacting layer is embedded into the monofilaments of the supporting layer is from 0.05 mm to 0.60 mm, and wherein a peel force between the web contacting layer and the supporting layer is from about 650 gf/inch to about 6000 gf/inch.

In an exemplary embodiment at least one of: a) at least some of the warp yarns; orb) at least some of the weft yarns, comprise polymers of varying crystallinities.

In an exemplary embodiment the non-woven web contacting layer comprises polymers of varying crystallinities.

In an exemplary embodiment tensile strength of the fabric is from 100 pli to 500 pli.

In an exemplary embodiment tensile strength of the fabric is from 200 pli to 450 pli.

In an exemplary embodiment compaction of the fabric is from 15% to 35%.

In an exemplary embodiment compaction of the fabric is from 20% to 30%.

BRIEF DESCRIPTION OF THE DRAWINGS

Exemplary embodiments of the present disclosure will be described with references to the accompanying figures, wherein.

DETAILED DESCRIPTION

Figure 1:
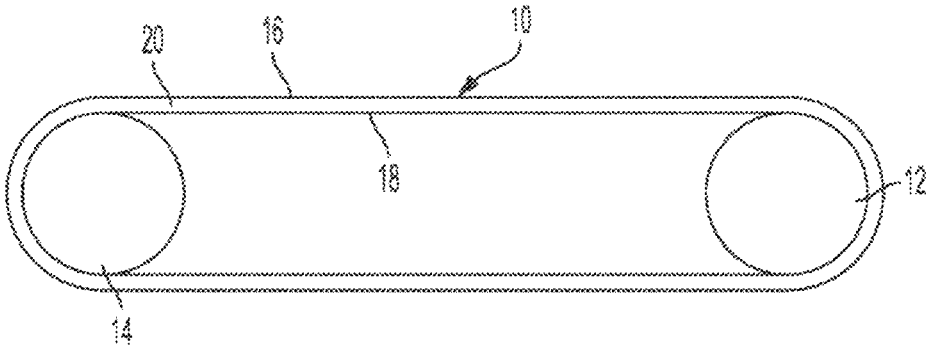
FIG. 1 shows a structured tissue belt assembly according to an exemplary embodiment of the present invention.

Certain terminology is used in the following description for convenience only and is not limiting. Fabrics according to the present invention are industrial textiles, which can have many industrial applications, such as conveyor belts, structuring (structured or imprinting) fabrics, etc. The words "support side" and "machine side" designate surfaces of the fabric with reference to their use in one application as a structuring fabric application; however, these terms merely represent first and second or upper and lower surfaces of the planar fabric. "Yarn" is used to generically identify a monofilament or multifilament fiber. "Warp" and "weft" are used to designate yarns or monofilaments based on their position in the loom that extend in perpendicular directions in the fabric and either could be a machine direction (MD) or cross-machine direction (CD) yarn in the fabric once it is installed on a piece of equipment, depending on whether the fabric is flat woven or continuously woven. As used herein, "laser energy scattering" means that the fiber or yarn or portions thereof contain agents which change the laser beam shape or profile and limit the laser intensity and heat generation and thus limit polymer degradation upon application of laser energy.

By way of background, the method described in U.S. patent application Ser. No. 16/881,219 laminates a web contacting layer to a supporting layer of a composite fabric using a laser. Some portions of the web contacting layer and/or supporting layer are taught to be laser energy absorbent, while other portions are laser energy transparent. It has been found that the laser energy transparent areas of the composite fabric can also absorb some of the laser energy during the lamination process. Without being bound by theory, this can decrease the overall tensile strength of the fabric and thus limit the duration the fabric can be utilized prior to failure on the paper machine. Loss of tensile strength may be the product of laser energy being converted to heat, resulting in molecular degradation of the polymer monofilaments of the woven supporting layer or of the polymers of the non woven web contacting layer even if the material is considered laser energy transparent.

In exemplary embodiments of the present invention, the amount of laser energy absorbed (and thus the amount of molecular degradation and tensile strength loss) by the polymers of the supporting layer and/or the web contacting layer can be controlled through the use of various techniques, such as, for example, incorporation of varying amounts of laser energy scattering material (which changes the laser beam profile or shape and intensity at a bonding interface), varying the crystallinity of the polymers used in some or all of the monofilaments of the supporting layer or the polymers of the nonwoven web contacting layer, and/or varying the wavelength of laser energy utilized for lamination. These techniques can also be used not only to control tensile loss of the composite fabric but the embedment distance of the nonwoven web contacting layer into the woven supporting layer.

The present invention provides structured fabrics with selective adhesion or connection of a web contacting layer to the supporting layer as well as between warp yarns and weft yarns within the supporting layer in order to provide a desired tensile strength, embedment distance, and flexibility and/or shear resistance of the composite fabric.

The selective adhesion is at least partially provided by the use of laser energy absorbent material verses laser energy scattering material in at least some monofilaments that make up the supporting layer of the fabric assembly (composite fabric) or in the polymers of the non woven web contacting layer. For example, every other cross direction monofilament used in the supporting layer of the composite fabric may contain a quantity of laser energy absorbing material. The remainder of the cross direction monofilaments and all of the machine direction monofilaments may contain a quantity of laser energy scattering material. The web contacting layer may have no or minor amounts of laser energy scattering material to allow for transmission of the laser energy through the web contacting layer into the supporting layer. The laser energy will be absorbed primarily by the cross direction monofilaments of the supporting layer with the laser energy absorbent material causing the polymers of the monofilament to form a first weld to the areas in contact with the web contacting layer. A second weld will be made where the cross direction monofilaments with the laser energy absorbing material come into contact with machine direction monofilaments of the supporting layer. Suitable laser energy absorbent materials include, but are not limited to pigments, dyes, carbon black, rubber, graphite, ceramic and combinations thereof. Suitable laser energy scattering materials include, but are not limited to titanium dioxide (rutile or anatase $TIO_2$), Anitmony Oxide, Zinc Oxide, Basic Carbonate, Lithopone, Clay, Magnesium Silicate Barytes, Calcium Carbonate or combinations thereof. The laser energy absorbent or scattering material may be mixed with the thermoplastic material used to form the web contacting layer or at least some of the warp yarns or the weft yarns, and/or coated onto the web contacting layer or fibers or yarns of the supporting layer. The amount of laser absorbent or scattering material in or on the web contacting layer or the fiber or yarn depends on the optical characteristics of the additive and properties of the polymer such as heat capacity and latent heat of fusion, but typically may range from about 0.05 percent to about 5 percent or from about 0.1 percent to about 5 percent by weight of the web contacting layer or fiber or yarn of the supporting layer. The yarns may be any shape, for example round, rectangular, square, multilobal, Y, star or other shapes. Other laser energy absorbent or scattering materials may also be used.

In an exemplary embodiment, the percentage of the warp yarns (monofilaments) or the weft yarns that contain laser energy absorbent material or scattering material may range from about 25% to about 100%. In some embodiments, only some of the weft yarns (for example, less than 25%) are formed at least in part of the laser energy absorbent or scattering material or some of the warp yarns (for example, less than 25%) are formed at least in part of the laser energy absorbent or scattering material.

In an exemplary embodiment, the cross direction yarns of the supporting layer contain laser energy absorbent material and the machine direction yarns contain laser energy scattering material. The nonwoven web contacting layer contains neither laser energy absorbent or scattering material. By adjusting how many of the weft and/or warp yarns that contain the laser energy absorbent material, as well as the specific weave pattern and degree of fabric sanding, more or less connection points with the web contacting layer can be designed into the fabric assembly and, to some degree, embedment depth and peel force can be controlled. Further, the specific number of the warp and/or weft yarns formed at least in part of the laser energy absorbent material verses laser energy scattering material, and weave pattern can also be used to define a number of welds between the crossing warp and weft yarns, which can be used to affect the flexibility and/or shear resistance and tensile strength of the fabric assembly.

The wavelength of the laser energy utilized as well as the degree of crystallinity of the polymers utilized in the composite fabric also can be used to control flexibility and/or shear resistance and tensile strength of the fabric assembly. In general, polymers with higher degrees of crystallinity will scatter a higher degree of laser energy and different polymers will absorb different wavelengths of laser energy, and thus polymer type, polymer crystallinity, as well as laser wavelength can affect the degree of energy absorbed and the resulting fabric properties.

In an arrangement in accordance with an exemplary embodiment, the woven supporting layer is flat woven and seamed at the warp ends in order to form a continuous belt, so that the warp yarns are MD yarns and the weft yarns are CD yarns. The supporting layer may be continuously woven, in which case, the weft yarns would extend in the MD and the warp yarns would extend in the CD. The supporting layer may also be a multiaxial fabric assembled from a strip of fabric having a narrower width that is wound around two spaced-apart rolls at an angle to the MD, with the longitudinal edges being joined together to form a wider fabric belt. The supporting layer may also be a dewatering fabric such as a press felt that contains one or several woven monofilament layers needled with fine synthetic batt. The monofilaments of the structuring layer can be made from thermoset or thermoplastic materials such as nylon, polybutylene terephthalate, polyphenylene sulfide, poly 1,4-cyclohexanedicarbinyl terephthalate polycyclohexanedimethylene terephthalate isophthalate, polyester, polyamide, polyurethane, polypropylene, polyethylene, polyethylene terephthalate (PET), polyether ether ketone resins and combinations thereof, or any other suitable material having the desired characteristics. One particularly suitable monofilament is Monalloy® monofilament (Asten Johnson, North Charleston, South Carolina, USA), made from polyurethane and polyethylene terephthalate, as described in U.S. Pat. Nos. 5,502,120 and 5,169,711, the contents of which are incorporated herein by reference in their entirety. The monofilaments can be bicomponent with a sheath and core structure, meaning the inner core of the monofilament is made of a different material than the outer sheath material. This may be preferred as the inner core material could have higher strength and flexibility properties while the outer material has higher temperature and abrasion resistance properties. Regardless of how the supporting layer is made, the designations of warp, weft and/or MD and CD as used in the description that follows can be interchanged.

The warp yarns and the weft yarns may be formed of a thermoplastic material but alternatively can be formed of a thermoset material or combination thereof. The web contacting layer may also be formed of a thermoplastic material but alternatively can be formed of a thermoset material or combination thereof. Bicomponent (two different polymers) or multicomponent (more than two different polymers) monofilaments can be utilized. For example, a bicomponent fiber with a sheath and core structure can be utilized, with a more specific example being a star shaped monofilament having a core polymer comprised of nylon or another high temperature resistant polymer and the sheath polymer comprised of thermoplastic polyurethane or polyethylene terephthalate.

Star shaped monofilaments can be defined as polymer extruded filaments that contain ridges and valleys in the longitudinal direction of the filaments around the entire circumference of the filament.

Exemplary embodiments of the present invention may include incorporation of star shaped monofilaments into the woven layer or layers of a structuring fabric. The structuring belt may be one of the following: a woven fabric, a woven fabric with an overlaid polymer, a woven fabric laminated with a 3-D printed web contacting or structuring layer, a laminated structuring fabric with a web-contacting layer made from extruded polymer netting laminated to a dewatering fabric, and a fabric comprising a web-contacting layer made from extruded polymer netting or 3-D printed material laminated to a triple layer woven fabric which is then laminated to a dewatering fabric where the fine synthetic batt fibers of the dewatering fabric are needled into the dewatering fabric and through the bottom layer of the triple layer woven fabric of the web contacting layer after the web contacting layer has been laminated to the dewatering fabric. The star shaped monofilaments can comprise a portion of, or the entirety of the cross direction wefts, the machine direction warps, or both in the woven layer or layers of the structuring fabric. It should be appreciated that the various exemplary embodiments of the present invention are not limited to the use of star shaped monofilaments.

Inclusion of star shaped monofilaments in the supporting layer of structuring fabrics provides multiple advantages. One advantage is improved drying of the paper web when using hot air, as in the Through Air Drying (TAD) process. Hot air impinges upon the paper web and can travel along the channels primarily in the X-Y plane to remove additional water from the web before completely passing through the web in the Z plane and into the TAD drum or TAD hood if the air flow is in the opposite direction. An advantage of additional drying is reduced fuel consumption in the burner used in the TAD system, which in turn results in monetary savings and less burden on the environment.

Another advantage of using star shaped monofilaments is the increased surface area for laser welding and connection of the supporting layer to the web contacting layer when manufacturing a composite or laminated fabric using the attachment method in accordance with exemplary embodiments of the present invention. This method involves use of a supporting woven layer including a top surface and a bottom surface, with the supporting woven layer being formed of warp yarns interwoven with weft yarns in a repeating pattern, and at least some of the warp yarns or the weft yarns being formed at least in part of a laser energy absorbent material and at least some of the warp yarns or weft yarns being formed at least in part of a laser energy scattering material. A web contacting layer such as extruded polymer netting or 3-D printed material is comprised of a polymer with no laser energy absorbing or scattering materials. The web contacting layer is attached to the top surface of the woven supporting layer via laser welds formed between a lower surface of the web contacting layer and the top surface of the woven supporting layer at points where the web contacting layer contacts the at least some of the warp yarns or the weft yarns that are formed or extruded at least in part of the laser energy absorbent material. With increased connected area between the supporting layer and web contacting layer, the connection strength between the two layers is greatly enhanced as measured by peel force strength. It is also important to recognize that in some embodiments, only the woven supporting layer yarns may contain laser energy absorbent material and thus the connection to the web contacting layer occurs as the web contacting layer is embedded into the softened polymers of the supporting layer areas that contain the laser energy absorbent material. The web contacting layer is preferably stretched and impinged into the top surface of the supporting layer, embedding into the softened material of these areas of the supporting layer. The impingement force can affect the depth of embedment of the web contacting layer into the web supporting layer, which in turn affects the peel force strength between the two layers. The amount the web contacting layer is stretched during lamination can also affect the peel force strength between the two layers as a stretched polymer diameter shrinks during stretching but attempts to enlarge to the pre-stretch diameter once the stretch force is removed. This attempt of the diameter of the web contacting layer to enlarge to the pre-stretch levels provides additional connection strength as measured by peel force strength. Without being bound by theory, it is also important to note that material differences between the web contacting layer and woven support layer may prevent actual chemical bonding between the two layers and thus the only mechanical connection forces holding the layers together could be the frictional forces between the two layers due to embedment depth and the frictional forces as the web supporting layer attempts to regain diameter after the stretching force is removed.

The layers of the fabric are laminated using the Through Transmission Laser Welding (TTLW) method where laser radiation is mostly passed through a transmissive first polymer and into a second absorbing polymer to create a weld. The lamination of the two layers together results in embedment of the materials of one layer with the materials of the other. The term "embedment" in this context may be defined as a connection between fabric polymers resulting from one or more of the following mechanisms: frictional forces generated by protrusion of the transmissive polymer into the absorbing polymer; frictional or compressive forces generated between the absorbing polymer and the stretched transmissive polymer as the transmissive polymer is relaxed and attempts to enlarge to its original shape; chemical bonds at the interface between the absorbing and transmissive polymer; and/or polymer intermixing in the molten state at the interface and then solidifying post cooling with the potential of dissimilar polymers forming interlocking orientations.

The selection of laser source for the welding of the polymers depends primarily on the emission wavelength and available output power of the source (the necessary power depends on wavelength, beam profile and polymers to be joined), beam characteristics of the source, and optical characteristics of the polymers at the joining interface (considers reflection, transmission and absorption). The types of laser best suited for the TTLW method include but are not limited to dye lasers, metal vapor lasers, gas lasers, solid state lasers (such as Nd:YAG or fiber lasers), and semiconductor lasers (also referred to as diode lasers). Each laser type emits a particular wavelength range which can range from 100 nm up to 1 mm. With each laser one can adjust laser power level, laser beam area, laser beam spot width, laser scanning speed, weld width, weld spacing, and weld pattern. A fiber laser with a Gaussian or Top Hat beam profile is preferred with a wavelength from about 500 to about 2200 nm, more preferably from about 800 to about 2000 nm, a circular shaped beam spot width range from about 0.2 mm to about 8 mm, a laser dot area from about 0.1 to about 220 $mm^2$, a laser power range from about 10 watts to about 1200 watts, more preferably about 100 watts to about 1200 watts, a roller optic speed range from about 0.1 to about 3 m/minute and a scanning speed range from about 0.1 to about 700 meters per minute. In general, the laser energy may be selected for a given spot or line beam size, welding speed, and absorption.

In an exemplary embodiment, the woven supporting layer includes star shaped monofilaments that are formed at least in part of the laser energy absorbent material and round shaped monofilaments that are formed at least in part of laser energy scattering material, and the contact time of the laser to the monofilaments is controlled so that only the tops of the ridge portions of the star shaped monofilaments plasticize and embed or connect to the web contacting layer. This leaves the air flow channels open in the X-Y plane for improved drying and flow of air when transporting a paper web through a hot air drying apparatus such as a Through Air Dryer. Not only does embedding of the web contacting layer into the woven web supporting layer hold the laminate fabric together, but an additional frictional or compressive force holds the two layers together as the stretched web contacting layer attempts to enlarge back to its original shape after the laser welding or lamination process. The embedding distance and frictional forces together provide a strong connection between the two layers between about 650 gf/inch to about 6000 gf/in or from about 650 gf/in to about 4500 gf/in of peel strength, more preferably about 2000 gf/inch to about 4000 gf/inch.

Figure 9:
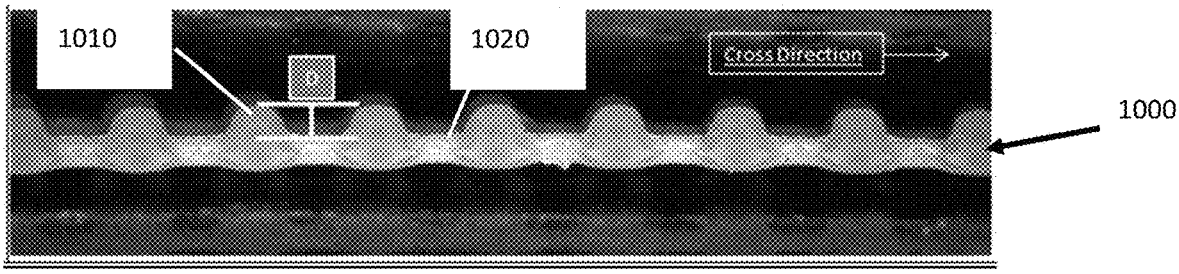
FIG. 9 is a cross-sectional view of a web contacting layer of a composite fabric according to an exemplary embodiment of the present invention.

In exemplary embodiments, as shown in FIG. 9, the distance (D) between the top plane of the ridges of the first elements 1010 and the top plane of the second elements 1020 is greater than 200 microns. During the papermaking process, the paper web being conveyed on the composite structuring fabric is transferred to the Yankee dryer at a nip formed between the Yankee dryer and a pressure roll. During this transfer (referred to herein as "soft nip transfer"), the extruded polymer netting of the composite structuring fabric is compressed in the nip between the pressure roll and Yankee dryer such that the top plane of the first element 1010 is in the same plane as the top plane of the second element 1020. A composite or laminated structuring fabric according to an exemplary embodiment of the present invention includes a web contacting layer with a top plane that has a contact area with the Yankee dryer between 15% to 45% in the uncompressed state but increases to 30 to 60% contact area in the compressed state when under 150 to 350 PLI load with nip width of 2.8 in. resulting in a load pressure of 420 psi to 980 psi, which is the typical load range that exists in the nip between the pressure roll and Yankee dryer. The contact area increases as the first elements 1010 are compressed into the same plane as the second elements 1020. Compressed state contact area can be controlled by the design of the top nonwoven or the chemistry/polymer composition of the top nonwoven to other ranges: for example, 35 to 50% or 30 to 85% or 40 to 65% or 20 to 85% or 35 to 85% or 38 to 75% or 33 to 70%.

FIG. 1 shows a belt, generally designated by reference number 10, made up of a fabric assembly 20 according to an exemplary embodiment of the present invention. The belt 10 has a support side surface 16 and a machine side surface 18 that extends between at least two conveyor rolls 12, 14. The belt 10 may be a papermaking fabric, such as, for example, structuring fabric, forming fabric, press fabric, and dryer fabric, that are used in papermaking machines. Further applications may include filter fabrics as well as other industrial applications.

In describing different embodiments of the fabric assemblies like element numbers are used for elements having the same function, even if there are minor differences in shape, such as yarns having different cross-sections.

Figure 2A:
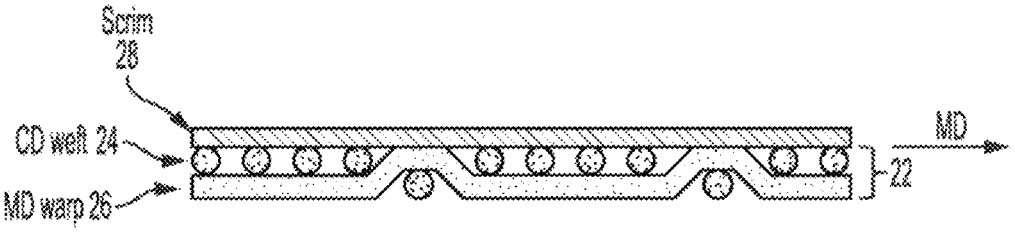
FIG. 2A-2C are cross-sectional views of a structured tissue belt assembly according to an exemplary embodiment of the present invention.

Referring to FIGS. 2A-2C and 3, an exemplary embodiment of a fabric assembly 20 according to the invention will be described in further detail. The fabric assembly 20 is formed from a supporting layer 22 having CD weft yarns 24 interwoven with MD warp yarns 26. As shown in FIG. 2A, in an initial step of a fabric manufacturing process according to an exemplary embodiment of the present invention, a web contacting layer 28 is placed on the top surface of the supporting layer 22.

The web contacting layer 28 may be a non-woven, non-fibrous web, such as an extruded netting, formed of a thermoplastic material, or 3-D printed material. The material for the web contacting layer may be, for example, polybutylene terephthalate (PBT), polyester, polyamide, polyurethane, polypropylene, polyethylene, polyethylene terephthalate (PET), polyether ether ketone resins and combinations thereof, or any other suitable material having desired characteristics. Other woven or non-woven materials may also be used. The web contacting layer may be laser energy transparent. In some embodiments, the web contacting layer is laser energy absorbing.

The CD weft yarns 24 and the MD warp yarns 26 may be formed of a thermoplastic material, such as a polyester, and at least some of the weft yarns 24 or the warp yarns 26, and in the case of the first embodiment, only the CD weft yarns 24 are formed at least in part of laser energy absorbent material and only the MD warp yarns 26 are formed at least in part of laser energy scattering material. In this case the laser energy absorbent material is carbon black which is mixed into the molten material used to form the weft yarns 24. However, in other exemplary embodiments of the invention, the weft yarns 24, the warp yarns 26, some of the weft yarns and some of the warp yarns 24, 26, or all of the weft yarns 24 and all of the warp yarns 26 may be formed at least in part with the laser energy absorbent material and/or the laser energy absorbent material.

In the present exemplary embodiment, the material of the web contacting layer 28, as described above, does not include any laser energy absorbent material and does not include any laser absorbent material. However, in other exemplary embodiments, the web contacting layer 28 may contain laser energy absorbent material and/or laser energy scattering material.

Figure 2B:
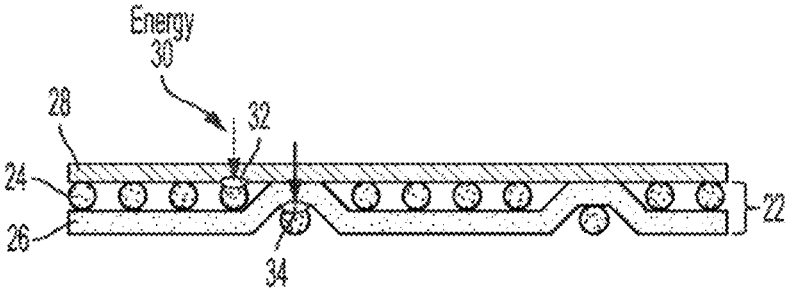
Figure 2C:
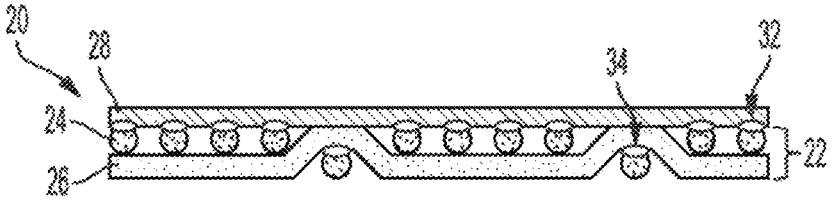
Figure 3:
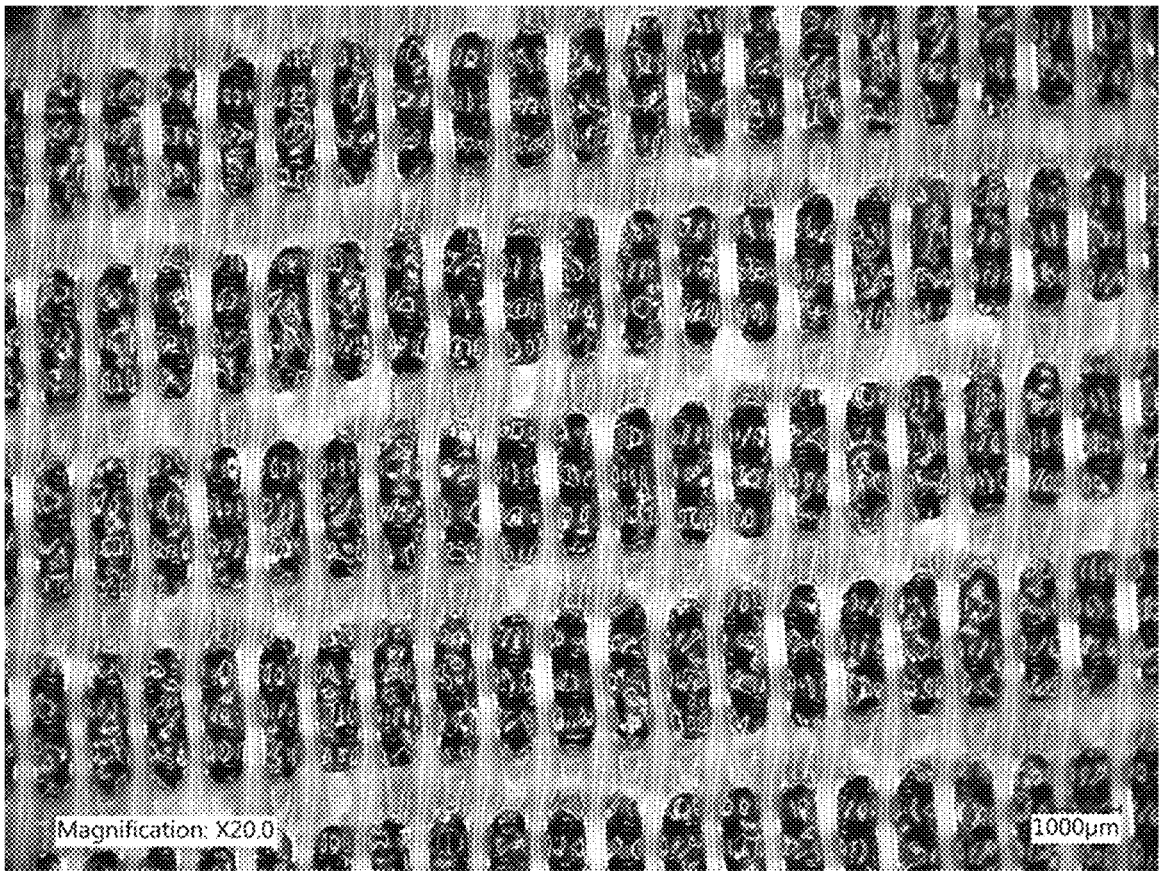
FIG. 3 is a top view of a laminated composite fabric of Comparative Example No. 2, with the web contacting layer shown as the clear to white color material laminated on top of the black monofilaments of the supporting layer where the weft and warp contain carbon black.
Figure 4:
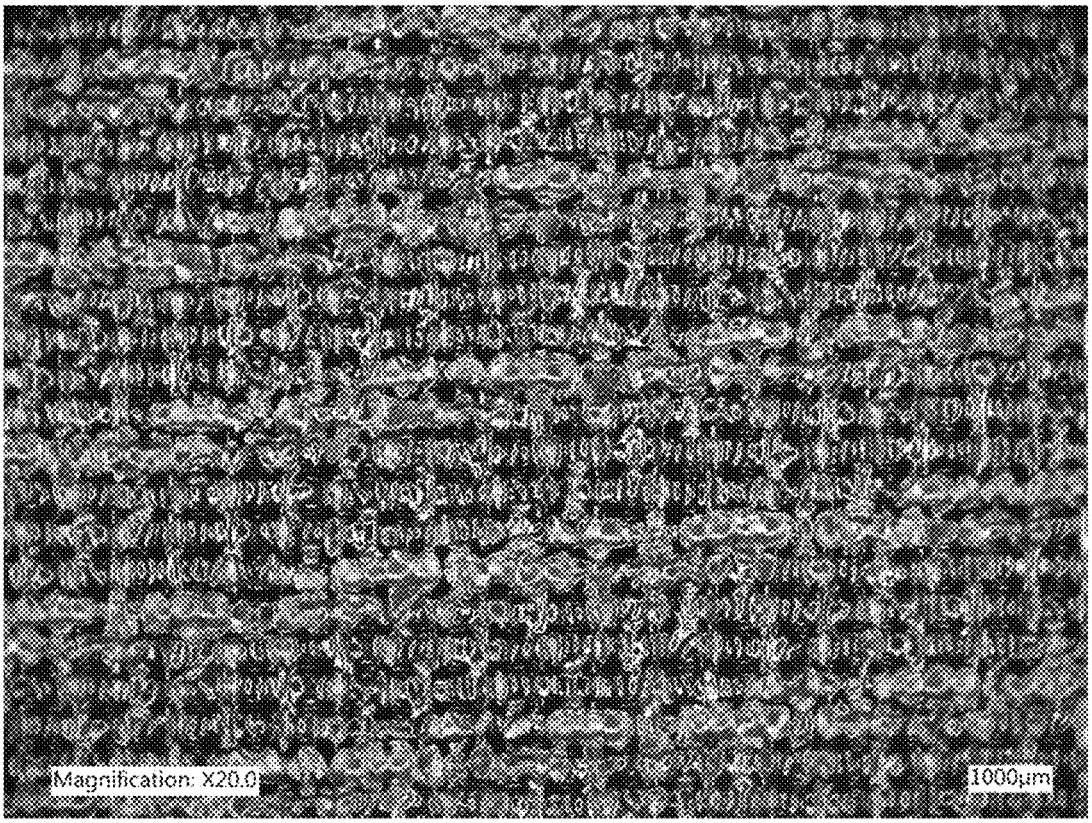
FIG. 4 shows a top view of the side of the supporting layer of the laminated composite fabric of Comparative Example No. 2 that was laminated to the web contacting layer after the supporting layer was peeled away from the web contacting layer. The deformation of the monofilaments, which had round CD and rectangular MD monofilaments prior to lamination, shows that the monofilaments plasticized during lamination allowing the web contacting layer to embed into the monofilaments of the supporting layer.
Figure 5:
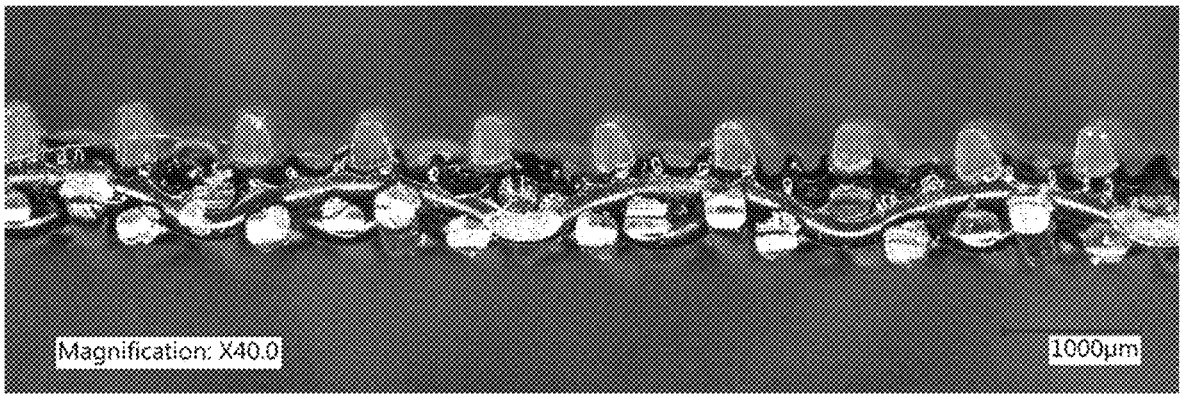
FIG. 5 is a cross-sectional view of the laminated composite fabric of Comparative Example No. 2 with the web contacting layer shown as the clear to white color material laminated on top of the black monofilaments of the supporting layer where the weft and warp contain carbon black. The figure shows deformation of the monofilaments in contact with the web contacting layer due to plasticizing during lamination with little to no deformation of the web contacting layer resulting in embedment of the web contacting layer into the monofilaments of the supporting layer.
Figure 6:
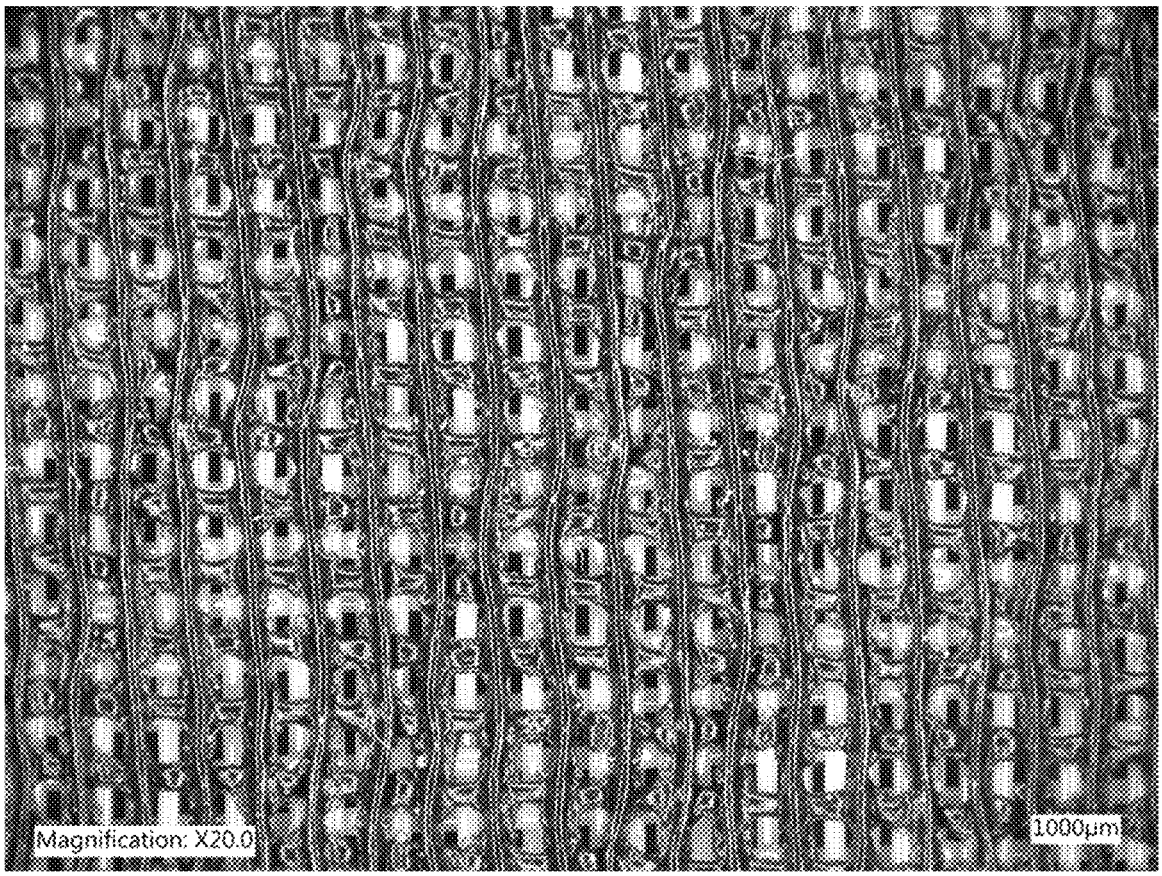
FIG. 6 is a top view of a laminated composite fabric of Comparative Example No. 3, with the web contacting layer shown as the black color material laminated on top of the clear to white color monofilaments of the supporting layer.
Figure 7:
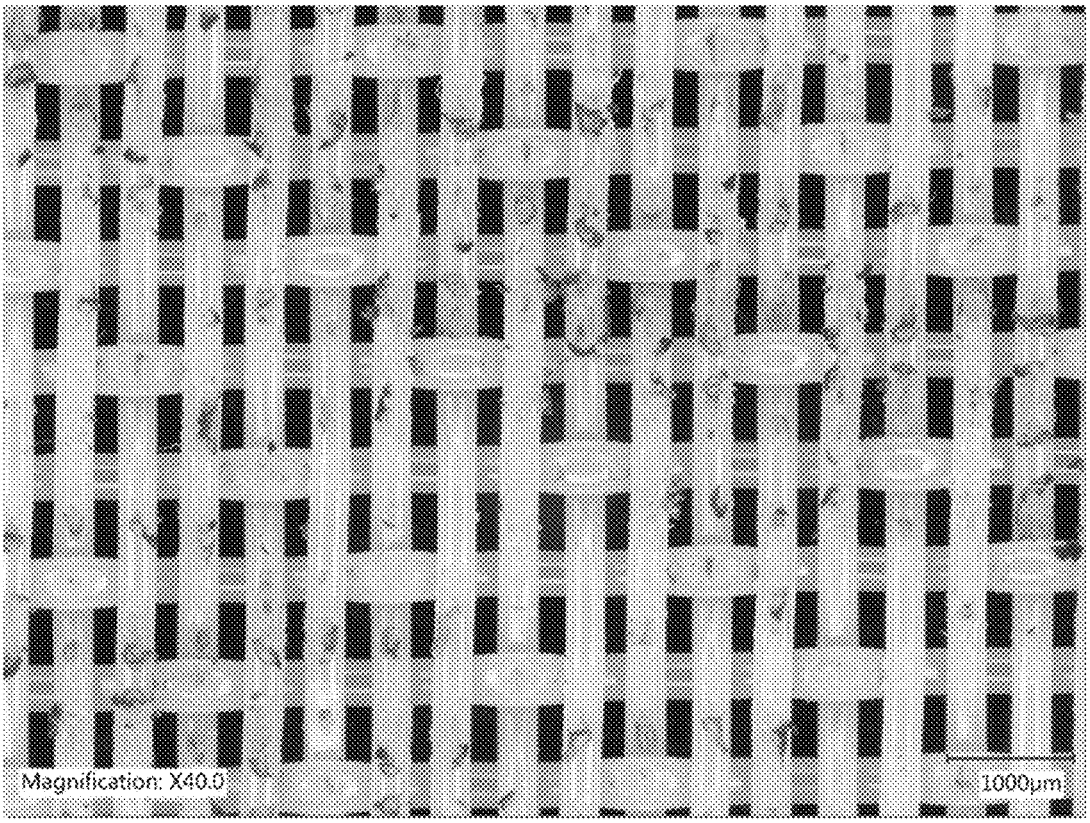
FIG. 7 shows a top view of the side of the supporting layer of the laminated composite fabric of Comparative Example No. 3 that was laminated to the web contacting layer after the supporting layer was peeled away from the web contacting layer. No deformation of the round CD or MD monofilaments is evident. This suggests that the web contacting layer plasticized allowing the monofilaments of the support layer to fuse with the web contacting layer.
Figure 8:
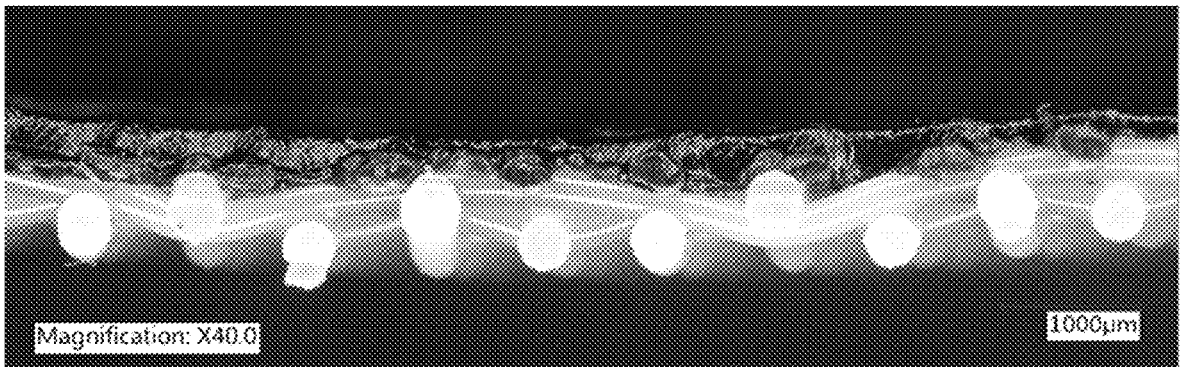
FIG. 8 is a cross-sectional view of the laminated composite fabric of Comparative Example No. 3 with the web contacting layer shown as the black color material laminated on top of the clear to white monofilaments of the supporting layer. The figure shows the deformation of web contacting layer, due to plasticizing during lamination, and fusion of the monofilaments of the supporting layer with the web contacting layer.

As shown in FIG. 2B, laser energy 30 is applied to the assembled components in order to form laser welds 32 between a lower surface of the web contacting layer 28 and a top surface of the supporting layer 22 at points where the web contacting layer 28 contacts the weft yarns 24 that are formed at least in part of the laser energy absorbent material. The laser welds 32 are formed between the laser energy transparent material of the web contacting layer 28 and the laser energy absorbent material in the weft yarns 24 at the points of contact, as shown in FIG. 2C. Additionally, welds 34 are formed in the supporting layer 22 at points where the warp yarns 26 which in this embodiment are formed of a laser energy scattering material and do not include any of the laser energy absorbent material, cross over the weft yarns 24 which are formed at least in part of the laser energy absorbent material.

TEST METHODS

Peel Force Test

An Instron Tensile Tester with two clamps was used to perform the peel force test. Three, one inch strips were cut from the belt in the machine direction (MD) each 4 in. long (100 mm). Initially, a small portion of the belt was peeled apart by hand, and then a strip from the papermaking top fabric and the woven bottom fabric was each placed in opposite clamps. The setting was set from 10 mm-90 mm of movement from the original length (10% to 90%) and a speed setting of 300 mm/min, and the Instron was started to peel the two strips from each other, while measuring the peel force result in N. The result was then converted to gf by multiplying by 102 unit conversion and averaged for the three strips.

Embedment Distance

To calculate embedment distance, perform a series of measurements using an AMES model AQD-2110 (1644 Concord Street in Framingham Massachusetts 01701, Tel #781 893-0095) caliper measurement device. Manually peel away and detach the web contacting layer from the woven supporting layer, until a large, flat area is produced, suitably sized for taking multiple measurements at different points. Using the AMES device, take at least 5 caliper readings at different points on the exposed woven supporting layer. Average these measurements together and record them. Do not allow the plunger to strike the material being measured, this will artificially reduce the caliper. Allow the plunger to gently contact the material. Next, perform the same series of 5 caliper readings on the web contacting layer which has been peeled away from the woven supporting layer. Average these measurements together and record them. Finally, measure the total thickness of the composite/laminated belt. Take 5 caliper readings, widely spaced, from a piece of composite/laminated belt which still has the web contacting layer embedded into the woven supporting layer and has not been peeled or disturbed. Average these measurements together and record them.

Theoretically, a fabric which has achieved no embedment of the web contacting layer into the woven supporting layer will have a total thickness equal to the web contacting layer thickness plus the woven supporting layer thickness. Using the data collected previously in this procedure, calculate the zero-embedment value by adding the average web contacting layer thickness to the average woven supporting layer thickness, and record this number.

To calculate the total embedment, subtract the total measured thickness value from the zero-embedment thickness value. The difference between these two numbers is the distance to which the web contacting layer has become embedded in the woven supporting layer.

It is important to recognize that embedment can occur where the web contacting layer embeds into the monofilaments of the supporting layer or where the monofilaments of the supporting layer embed into the web contacting layer. Embedment where the web contacting layer embeds into the monofilaments of the supporting layer occurs when the monofilaments of the supporting layer plasticize under applied energy, such as by laser or ultrasonic energy, allowing the web contacting layer to sink into the monofilaments before the applied energy is removed and the monofilaments solidify. Embedment where the monofilaments of the supporting layer embed into the web contacting layer occurs when the web contacting layer platicizes under applied energy, such as by laser or ultrasonic energy, allowing the monofilaments to sink into the web contacting layer before the applied energy is removed and the web contacting layer solidifies. Embedment can also occur where both the monofilaments of the supporting layer and the polymers of the web contacting layer both plasticize under applied energy and the two layers sink into each other prior to solidifying after removal of the applied energy.

Example Measurements for Original Pet Netting

Measured web contacting layer thickness: 0.76 mm
Measured base woven supporting layer thickness: 0.90 mm
Calculated theoretical thickness: 0.76+0.90=1.66 mm
Measured embedded thickness: 1.30 mm
Calculated total embedment: 1.66−1.30=0.36 mm
Calculated embedment percentage: ((1.66−1.30)/1.66)×100%=21.69%

Shear Resistance

To calculate shear resistance, prepare samples by the following method. First, cut two samples from the composite belt or fabric, one at a 45 degree angle to the weft line, the second at a 135 degree angle to the weft line. These samples are to be 2.0±0.1 inches wide by a minimum of 9 inches long.

Next, mount the sample in the clamps of a Constant Rate Extension (CRE) testing machine such as an Instron 3343 tensile tester, manufactured by Instron of Norwood, MA The CRE machine is to be set at a 6.0 inch gauge length, a crosshead speed of 1 inch/minute, and a load range of 3.0 lbs, with a 100 lb load cell recommended. Cycle the CRE machine from 0 to 2 lbs/inch, then back to 0. Shear number is determined by measuring the fabric elongation between 0.5 to 2 lbs/inch of loading. The average shear number will be determined as the average of the 45 degree and 135 degree sample values.

Shear number may be calculated according to formula (1) as follows:

$$\text{Shear Number}=(\text{Load Range}\times\text{Gauge Length})/(\text{Fabric Elongation}\times\text{Sample Width}). \quad (1)$$

The Shear Number has units PLI.

Applying formula (1) in this case results in the following calculation:

Shear Number=(3 lbs×6 in.)/(Fabric Elongation×2 in.)

This simplifies to Shear Number=9 (lbs)×Fabric Elongation (inches)

46=9×(Fabric Elongation), therefore Fabric Elongation=5.1 inches.

Permeability

Test by following the manual instructions of the TEXTEST FX 3300 LabAir IV available from TEXTEST AG, CH-8603 Schwerzenbach, Switzerland. The instrument works in accordance with ASTM D 737 test method, Standard Test Method for Air Permeability of Textile Fabrics. Select test area of 38 $cm^2$, test pressure of 125 Pa, and $ft^3/ft^2/min$ for unit of measure, for the ASTM D 737 test method. Reset unit to zero. Load sample and start test by pressing down the clamping arm. The test sample is clamped to the test head and the vacuum pump is automatically started. The orifice plate within the unit automatically adjusts to select the proper orifice size and opening for the air flow and permeability range of the sample. Wait until the air flow reaches a constant level, then save the reading. Test 5 different samples and each test is recorded on the print out.

Tensile Strength

For measuring the tensile strength of yarns by the single strand method, utilize ASTM D2256-10.

For measuring the tensile strength of fabrics, utilize ASTM D76-11

Preferred testing equipment is a tensile machine of the constant rate of extension type running Instron BlueHill 3 software, with a gauge length of 250 mm and a crosshead speed of 250 mm/min.

Polymer Crystallinity

Calculate % crystallinity using Differential Scanning calorimetry (DSC).

Crystallinity may be calculated in accordance with the following formulas:

$$W_c=\Delta H_m/\Delta H_m^0\times 100[\%] \quad (2)$$

where:

the term $\Delta H_m^0$ is the value for 100% crystalline material (for polyethylene PET, the value is 140 J/g), the term $\Delta H_m$ is the heat of fusion (melt enthalpy) measured by the DSC (for a highly oriented polyethylene terephthalate (PET) monofilament used in making paper machine fabrics, this value is 57 J/g), and Wc is the degree of crystallinity.

For the above PET monofilament, the Wc=57/140×100=40.7%.

Table 1 below provides the percent chrystalinity measured using DSC of PET monolfilaments used in various exemplary embodiments of the present invention. For the DSC, the heating rate was 10 C/min, the first scan was used, and the temperature range was 20-300 C. The AW150-LW weft yarns contain carbon black.

TABLE 1

| | | | DSC Method | | | |
|---|---|---|---|---|---|---|
| Material | | Polymer | Tm ° C. | $\Delta Hm^0$ J/g | ΔHm J/g | Wc |
| .22 × .27-AW550 | Warp | PET | 252.3 | 140 | 55.01 | 39.3% |
| .35-AW150-LW | Weft | PET | 251.7 | 140 | 54.67 | 39.1% |
| .22 × .27-AW550 Unstab 3% $TiO_2$ | Warp | PET | 248.3 | 140 | 61.55 | 44.0% |

Compression Testing

The custom built laboratory dynamic compression tester consists of rotating cam and follower which moves an action rod. The action rod loads the test cell which is mounted on an air cylinder and reservoir to absorb the shock of impact and provide constant force. The tester is instrumented with piezoelectric dynamic force sensor to measure the load, and proximity sensors to measure the caliper of the samples. Two identical samples are tested simultaneously, and each 4 $in^2$. The samples are placed in a wet heated test cell. A pressure of 4 Mpa at 40° C. was applied at a frequency of 5 Hz and dwell time of 50 ms for 10,000 compression cycles using the laboratory dynamic compression tester. Data is acquired at predetermined cycles. The loading and unloading curves for the sample are produced pressure and caliper measurements.

EXAMPLES

Comparative Example No. 1

A woven structuring fabric was provided having 0.35 mm wide by 0.28 mm height cross-section rectangular MD yarns at 44 yarns/inch, and 0.50 mm diameter round CD yarns at 29 yarns/inch. The weave pattern was a 5-shed, 1 MD yarn over 4 CD yarns, then under 1 CD yarn, then repeated. The yarns were 100% polyethylene terephthalate (PET) with 40% crystallinity. The fabric caliper was 0.98 mm with 690 cfm air permeability and a fabric tensile strength of 413 PLI. Compression testing of the fabric according to the aforementioned test procedure showed a 7% reduction in caliper under load during the first compression, and a 6% reduction in caliper under load during the 10,000th compression.

Comparative Example No. 2

A laminated composite fabric or belt, TPU 30×9, was provided having a web contacting layer with the following characteristics and geometries: extruded netting with MD strands of 0.26 mm width×CD strands of 0.46 mm width, with a mesh of 30 MD strands per inch and a count of 9 CD strands per inch, % contact area of 26% with solely MD strands in plane in static measurement and then with 48% contact area under load as the structure compressed and the CD strands or "mid-ribs" moved into the same plane as the MD strands, due to use of the thermoplastic polyurethane ("TPU") elastomeric material. The TPU material is a softer material and measured in the range of 65 to 75 Shore A Hardness while the woven supporting layer comprised of harder polyethylene terephthalate (PET) measured 95 to 105 Shore A Hardness using a portable Shore A Durometer test device calibrated per ASTM D 2240, the Mitutoyo Hardmatic HH-300 series, ASTD. The distance between MD strands in the web contacting layer was 0.60 mm, and the distance between the CD strands was 2.25 mm. The overall pocket depth was equal to the thickness of the TPU netting, which was equal to 0.50 mm. The pocket depth from the top surface of the netting to the CD mid-rib was 0.25 mm. The TPU netting was a natural color, the TPU 30×9 laminated belt had an air permeability of 330 cfm with a caliper of 1.08 mm. The peel force required to remove the web contacting layer from the woven supporting layer was 2628 gf/inch and the shear number was 225 PLI. The embedment distance was 0.26 mm. Since the web contacting layer was TPU based and supporting layer was polyester based, the layers plasticized and flowed over each other when laser energy was applied and then mechanically interlocked once the laser energy was removed and the polymers solidified. Chemical bonds cannot form between TPU in the web contacting layer and the polyester based PET in the supporting layer. The supporting layer had a 0.27×0.22 mm cross-section rectangular MD yarn at 56 yarns/inch, and a 0.35 mm diameter CD yarn at 41 yarns/inch. The weave pattern of the base layer was a 5-shed, 1 MD yarn over 4 CD yarns, then under 1 CD yarn, then repeated. The side of the supporting layer fabric with the long weft knuckles was laminated to the web contacting layer. The material of the supporting layer yarns was 100% PET at 39% crystallinity. The weft yarns received 0.40% carbon black content by weight in the CD, and the warp yarns received 0.14% carbon black content by weight in the MD. A Mylar protective cover sheet or film was tensioned to approximately 66 PLI to apply a downward force of 11 PSI between the contacting layer and the supporting layer as the fabrics were traversed across a 6 inch radius welding roll. Mylar, also known as BoPET (Biaxially-oriented polyethylene terephthalate) is a polyester film made from stretched polyethylene terephthalate (PET) and is used for its high tensile strength, and chemical and dimensional stability. Other films can be used if they are non-stick and they are able to maintain dimensional stability. Suitable other non-stick films include polytetrafluorethylene (TEFLON), silicone treated films and the like. By non-stick is meant having a surface energy between about 10 $mj/m^2$ to about 200 $mj/m^2$. The Preco non contacting 1070 nm continuous wave welding laser (Preco, Inc., 500 Laser Drive, Somerset, WI 54025, USA) was set to 550 W at a welding head speed of 500 inches/sec with a diagonal optical line width of 0.5 inches with 0.01 inches spacing between laser passes. The fabric was traversing at a rate of 0.15 inches/sec across the welding roll as lamination occurred. The composite fabric tensile strength was 88 PLI. Compression testing of the composite fabric according to the aforementioned test procedure showed a 21% reduction in caliper under load during the first compression, and a 18% reduction in caliper under load during the $10,000^{th}$ compression.

Example No. 1

A laminated composite fabric or belt, TPU 30×9, is provided having a web contacting layer with the following characteristics and geometries: extruded netting with MD strands of 0.26 mm width×CD strands of 0.46 mm width, with a mesh of 30 MD strands per inch and a count of 9 CD strands per inch, % contact area of 26% with solely MD strands in plane in static measurement and then with 48% contact area under load as the structure compresses and the CD strands or "mid-ribs" moves into the same plane as the MD strands, due to use of the thermoplastic polyurethane ("TPU") elastomeric material. The TPU material is a softer material and measures in the range of 65 to 75 Shore A Hardness while the woven supporting layer comprised of harder PET measures 95 to 105 Shore A Hardness using a portable Shore A Durometer test device calibrated per ASTM D 2240, the Mitutoyo Hardmatic HH-300 series, ASTD. The distance between MD strands in the web contacting layer was 0.60 mm, and the distance between the CD strands or "mid-ribs" was 2.25 mm. The overall pocket depth was equal to the thickness of the TPU netting, which was equal to 0.50 mm. The pocket depth from the top surface of the netting to the CD mid-ribs was 0.25 mm. The TPU netting had a natural color, and the air permeability of the TPU 30×9 laminated belt was 330 CFM with a caliper of 1.12 mm. The peel force required to remove the web contacting layer from the woven supporting layer was 2500 gf/inch and the shear number was 205 PLI. The embedment distance was 0.23 mm. The supporting layer had a 0.27×0.22 mm cross-section rectangular MD yarn at 56 yarns/inch, and a 0.35 mm CD yarn at 41 yarns/inch. The weave pattern of the base layer was a 5-shed, 1 MD yarn over 4 CD yarns, then under 1 CD yarn, then repeated. The side of the supporting layer fabric with the long weft knuckles was laminated to the web contacting layer The material of the supporting layer MD warp yarns was 100% PET at 44% crystallinity while the weft was also 100% PET but at 39% crystallinity. The weft yarns received 0.40% carbon black content by weight in the CD, and the warp yarns received 0.0% carbon black content by weight and 3.0% by weight titanium dioxide in the MD. A Mylar protective cover sheet or film was tensioned to approximately 66 PLI to apply a downward force of 11 PSI between the contacting layer and the supporting layer as the fabrics traversed across 6 inch radius welding roll. Mylar, also known as BoPET (Biaxially-oriented polyethylene terephthalate) is a polyester film made from stretched polyethylene terephthalate (PET) and is used for its high tensile strength, and chemical and dimensional stability. Other films could have been used if they were non-stick and they were able to maintain dimensional stability. Suitable other non-stick films include polytetrafluorethylene (TEFLON), silicone treated films and the like. By non-stick is meant having a surface energy between about 10 mj/m$^2$ to about 200 mj/m$^2$. The Preco non contacting 1070 nm continuous wave welding laser (Preco, Inc., 500 Laser Drive, Somerset, WI 54025, USA) was set to 550 W at a welding head speed of 500 inches/sec with a diagonal optical line width of 0.5 inches with 0.01 inches spacing between laser passes. The fabric was traversing at a rate of 0.15 inches/sec across the welding roll as lamination occurred. The composite fabric tensile strength was 325 PLI. Compression testing of the composite fabric according to the aforementioned test procedure showed a 21% reduction in caliper under load during the first compression, and a 18% reduction in caliper under load during the 10,000 compression.

Comparative Example No. 3

A laminated composite fabric was provided of the type disclosed in U.S. Pat. No. 10,208,426 (the contents of which are incorporated herein by reference in their entirety) with the web contacting layer having the following characteristics: extruded polybutylene terephthalate netting with MD strands of 0.28 mm width×CD strands of 0.38 mm width, with a mesh of 26.5 MD strands per inch and a count of 24 CD strands per inch. The supporting layer was a woven fabric with a weave pattern of a 5-shed, 1 MD yarn over 4 CD yarns, then under 1 CD yarn, then repeated. The supporting layer was sanded to 25% contact area. The mesh of the supporting layer was 50.5 yarns/in, with a 0.3 mm diameter yarn, with a count of 30.5 yarns/inch, with a 0.35 mm diameter yarn, where the yarns were comprised of 100% polyethylene terephthalate at 40% crystallinity. The supporting layer was laminated to the web contacting layer by ultrasonic fusing with the short weft knuckle side of the supporting layer laminated to the web contacting layer. The laminated belt had a caliper of 1.05 mm, an air permeability of 360 cfm, a peel strength of 3062 gf/inch and a fabric tensile strength of 453 PLI. The embedment distance was 0.36 mm, but since the web contacting layer and supporting layer were polyester based, they melted and fused together during the welding process to form chemical bonds. Compression testing of the composite fabric according the aforementioned test procedure showed a 13% reduction in caliper under load during the first compression, and a 12% reduction in caliper under load during the 10,000$^{th}$ compression.

Comparative Example No. 4

A structuring fabric was provided of the type disclosed in U.S. Pat. No. 8,216,427 (the contents of which are incorporated herein by reference in their entirety), where the structuring layer (web contacting layer) had a plurality of identical depressions arranged in parallel rows extending in the machine direction of the fabric and the wear layer was comprised of a layer similar to a press felt. The caliper of the composite fabric was 3.2 mm with an air permeability of 23 cfm. Compression testing of the composite fabric according to the aforementioned test procedure showed a 14% reduction in caliper under load during the first compression, and a 12% reduction in caliper under load during the 10,000th compression.

Comparative Example No. 5

A structuring fabric was provided of the type disclosed in U.S. Pat. No. 8,216,427 (the contents of which are incorporated herein by reference in their entirety), where the structuring layer (web contacting layer) had a plurality of identical depressions arranged in parallel rows extending in the machine direction of the fabric and the wear layer was comprised of a woven fabric layer. The caliper of the composite fabric was 1.1 mm with an air permeability of 65 cfm. Compression testing of the composite fabric according to the aforementioned test procedure showed a 6% reduction in caliper under load during the first compression, and a 6% reduction in caliper under load during the 10,000th compression.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

We claim:

1. A structured tissue belt assembly, comprising:

a supporting layer comprising a top surface and a bottom surface, the supporting layer being formed of monofilaments comprising one or more layers of warp yarns interwoven with weft yarns in a repeating pattern, at least one of: a) at least some of the warp yarns; orb) at least some of the weft yarns, comprising laser energy absorbent material, at least one of: a) at least some of the warp yarns; orb) at least some of the weft yarns, comprising laser energy scattering material;

a non-woven web contacting layer comprising a bottom surface; and one or more first laser welds that attach the bottom surface of the non-woven web contacting layer to the top surface of the supporting layer at points where the non-woven web contacting layer contacts the at least one of: a) the at least some of the warp yarns; or b) the at least some of the weft yarns that comprise laser energy absorbent material, wherein the structured tissue belt assembly allows for air flow in x, y and z directions, wherein an embedment distance where the web contacting layer is embedded into the monofilaments of the supporting layer is from a distance of 0.05 mm to 0.60 mm, and wherein a peel force between the web contacting layer and the supporting layer is from 650 gf/inch to 6000 gf/inch.

2. The structured tissue belt assembly of claim 1, wherein at least one of: a) at least some of the warp yarns; or b) at least some of the weft yarns, comprise polymers of varying crystallinities.

3. The structured tissue belt assembly of claim 1, wherein the non-woven web contacting layer comprises at least one of a laser energy scattering material or polymers of varying crystallinities.

4. The structured tissue belt assembly of claim 1, wherein at least some of the weft yarns are formed at least in part of the laser energy absorbent material.

5. The structured tissue belt assembly of claim 4, wherein at least some of the warp yarns are devoid of the laser energy absorbent material and contain a laser energy scattering material.

6. The structured tissue belt assembly of claim 4, wherein at least some of the warp yarns are formed of a laser energy scattering material and the at least some of the warp yarns are connected to the at least some of the weft yarns formed at least in part of the laser energy absorbent material at one or more second laser welds formed at points where the warp yarns pass over the weft yarns formed at least in part of the laser energy absorbent material.

7. The structured tissue belt assembly of claim 4, wherein the web contacting layer is attached to the top surface of the supporting layer by the one or more first laser welds formed between the bottom surface of the web contacting layer and the at least some of the weft yarns formed at least in part of the laser energy absorbent material at points where the at least some of the weft yarns form at least part of the top surface.

8. The structured tissue belt assembly of claim 1, wherein at least some of the warp yarns are formed at least in part of the laser energy absorbent material.

9. The structured tissue belt assembly of claim 8, wherein at least some of the weft yarns are devoid of laser energy absorbent material and contain a laser energy scattering material.

10. The structured tissue belt assembly of claim 8, wherein at least some of the weft yarns are formed of a laser energy scattering material and the at least some of the weft yarns are connected to the at least some of the warp yarns formed at least in part of the laser energy absorbent material at one or more second laser welds formed at points where the weft yarns pass over the warp yarns formed at least in part of the laser energy absorbent material.

11. The structured tissue belt assembly of claim 8, wherein the web contacting layer is attached to the top surface of the supporting layer by the one or more first laser welds formed between the bottom surface of the web contacting layer and the at least some of the warp yarns formed at least in part of the laser energy absorbent material at points where the at least some of the warp yarns form at least part of the top surface.

12. The structured tissue belt assembly of claim 1, wherein the warp yarns and the weft yarns are formed at least in part of a thermoplastic polymer, a thermoset polymer, or a combination thereof.

13. The structured tissue belt assembly of claim 10, wherein the polymer type is polyphenylene sulfide, poly 1,4-cyclohexanedicarbinyl terephthalate, polycyclohexanedimethylene terephthalate isophthalate, polybutylene terephthalate, polyester, polyamide, polyurethane, polypropylene, polyethylene, polyethylene terephthalate, polyether ether ketone resins or combinations thereof.

14. The structured tissue belt assembly of claim 1, wherein the warp yarns and the weft yarns are bicomponent yarns.

15. The structured tissue belt assembly of claim 1, wherein the warp yarns and the weft yarns have a consistent shape.

16. The structured tissue belt assembly of claim 1, wherein the warp yarns and the weft yarns have a varying shape.

17. The structured tissue belt assembly of claim 1, wherein the warp and the weft yarns have a shape selected from the group consisting of: circular, rectangular, star shaped, and oval shaped.

18. The structured tissue belt assembly of claim 1, wherein the web contacting layer is formed of an extruded polymer netting or a 3-D printed polymer.

19. The structured tissue belt assembly of claim 18, wherein the polymer is a thermoplastic polymer, a thermoset polymer, or a combination thereof.

20. The structured tissue belt assembly of claim 17, the polymer is polyphenylene sulfide, poly 1,4-cyclohexanedicarbinyl terephthalate, polycyclohexanedimethylene terephthalate isophthalate, polybutylene terephthalate, polyester, polyamide, polyurethane, polypropylene, polyethylene, polyethylene terephthalate, polyether ether ketone resins or combinations thereof.

21. The structured tissue belt assembly of claim 1, the laser energy absorbent material comprises carbon black.

22. The structured tissue belt assembly of claim 21, the carbon black is present in at least one of the at least some of the warp yarns or the at least some of the weft yarns by an amount of from 0.05% to 5% by weight.

23. The structured tissue belt assembly of claim 4, wherein the at least some of the weft yarns that are formed at least in part of the laser energy absorbent material is from 20% to 100% of all weft yarns in the fabric assembly.

24. The structured tissue belt assembly of claim 8, wherein the at least some of the warp yarns that are formed at least in part of the laser energy absorbent material is from 25% to 100% of all warp yarns in the fabric assembly.

25. The structured tissue belt assembly of claim 1, wherein the laser energy scattering material comprises titanium dioxide.

26. The structured tissue belt assembly of claim 25, wherein the titanium dioxide is present in at least one of: a) at least some of the warp yarns; or b) at least some of the weft yarns, by an amount of from 0.05% to 5% by weight.

27. The structured tissue belt assembly of claim 4, wherein the at least some of the weft yarns that are formed at least in part of the laser energy scattering material is from 20% to 100% of all weft yarns in the fabric assembly.

28. The structured tissue belt assembly of claim 8, wherein the at least some of the warp yarns that are formed at least in part of the laser energy scattering material is from 25% to 100% of all warp yarns in the fabric assembly.

29. The structured tissue belt assembly of claim 1, wherein the non-woven web contacting layer comprises a laser energy scattering material in an amount from 0.0% to 5% by weight.

30. The structured tissue belt assembly of claim 1, wherein the peel force is from 2000 gf/in to 4500 gf/in.

31. The structured tissue belt assembly of claim 1, wherein a shear number of the structured tissue fabric belt assembly is from 35 PLI to 250 PLI.

32. The structured tissue belt assembly of claim 31, wherein the shear number is from 150 PLI to 225 PLI.

33. The structured tissue belt assembly of claim 1, wherein the embedment distance is from 0.10 mm to 0.36 mm.

34. The structured tissue belt assembly of claim 1, wherein the supporting layer comprises polymers of varying crystallinities, wherein the crystallinity of the polymers vary from 30% to 60%.

35. The structured tissue belt assembly of claim 1, wherein tensile strength of the fabric is from 100 pli to 500 pli.

36. The structured tissue belt assembly of claim 1, wherein tensile strength of the fabric is from 200 pli to 450 pli.

37. The structured tissue belt assembly of claim 1, wherein compaction of the fabric is from 15% to 35%.

38. The structured tissue belt assembly of claim 1, wherein compaction of the fabric is from 20% to 30%.

* * * * *